US010582299B1

(12) United States Patent
Mansour et al.

(10) Patent No.: US 10,582,299 B1
(45) Date of Patent: Mar. 3, 2020

(54) MODELING ROOM ACOUSTICS USING ACOUSTIC WAVES

(71) Applicant: Amazon Technologies, Inc., Seattle, WA (US)

(72) Inventors: Mohamed Mansour, Cupertino, CA (US); Guangdong Pan, Quincy, MA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/216,599

(22) Filed: Dec. 11, 2018

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01)

(58) Field of Classification Search
CPC ..... H04R 1/406; H04R 3/005
See application file for complete search history.

(56) References Cited

U.S. PATENT DOCUMENTS

2015/0163593 A1* 6/2015 Florencio ..... G10K 11/16 381/66
2015/0334505 A1* 11/2015 Crutchfield ..... H04R 29/002 381/17

* cited by examiner

*Primary Examiner* — Regina N Holder
(74) *Attorney, Agent, or Firm* — Pierce Atwood LLP

(57) ABSTRACT

Techniques for simulating a microphone array and generating synthetic audio data to analyze the microphone array geometry. This reduces the development cost of new microphone arrays by enabling an evaluation of performance metrics (False Rejection Rate (FRR), Word Error Rate (WER), etc.) without building device hardware or collecting data. To generate the synthetic audio data, the system performs acoustic modeling to determine a room impulse response associated with a prototype device (e.g., potential microphone array) in a room. The acoustic modeling is based on two parameters—a device response (information about acoustics and geometry of the prototype device) and a room response (information about acoustics and geometry of the room). The device response can be simulated based on the microphone array geometry, and the room response can be determined using a specialized microphone and a plane wave decomposition algorithm.

20 Claims, 17 Drawing Sheets

MODELING ROOM ACOUSTICS USING ACOUSTIC WAVES

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

DETAILED DESCRIPTION

Electronic devices may be used to capture audio and process audio data. The audio data may be used for voice commands and/or sent to a remote device as part of a communication session. To process voice commands from a particular user or to send audio data that only corresponds to the particular user, the device may attempt to isolate desired speech associated with the user from undesired speech associated with other users and/or other sources of noise, such as audio generated by loudspeaker(s) or ambient noise in an environment around the device.

A geometry of a microphone array of the device may affect the processed audio. However, testing the microphone array and/or different geometries of the microphone array requires building a physical model or prototype of the device and performing additional testing using the physical device.

Figure 1:
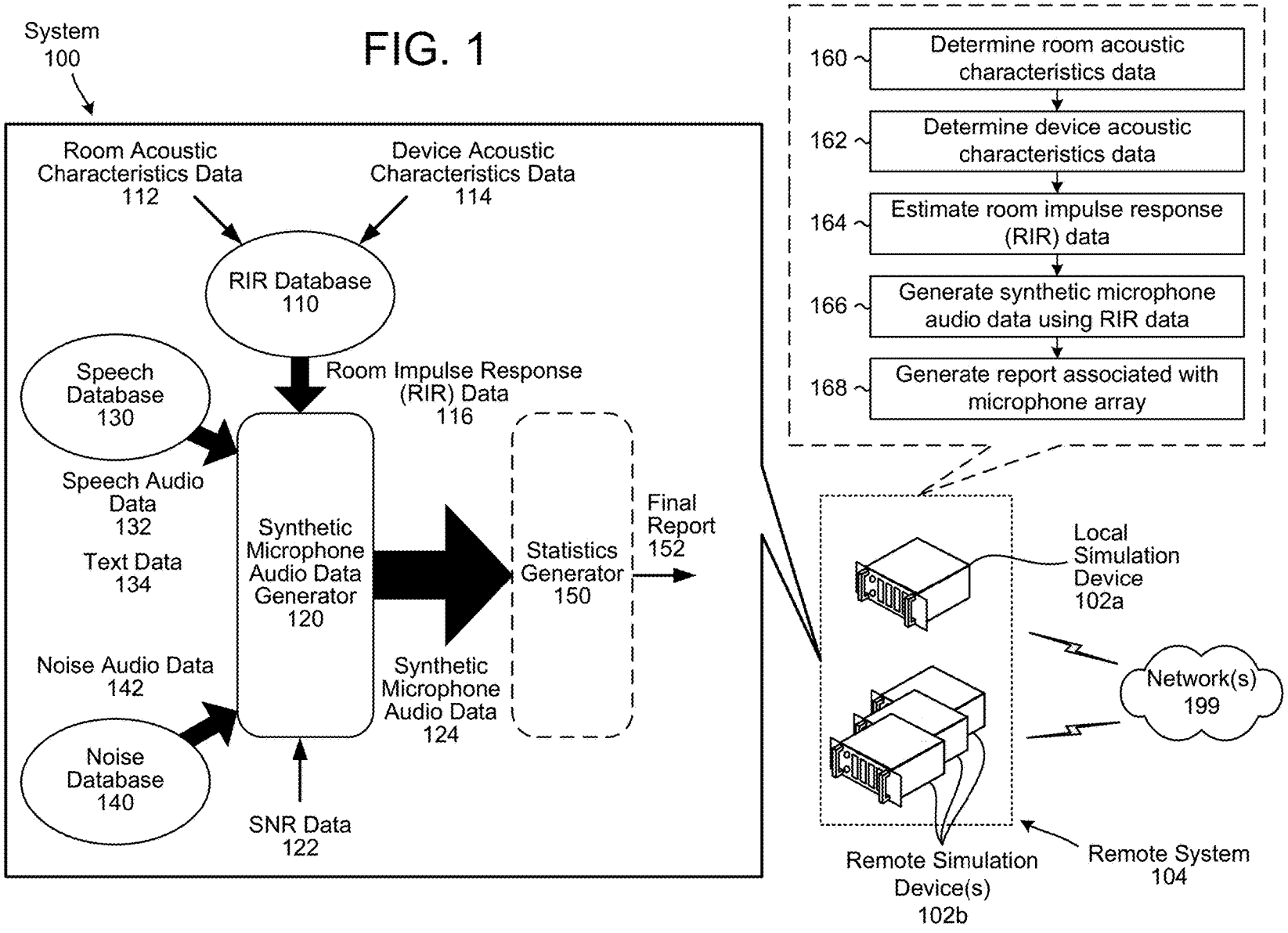
FIG. 1 illustrates a microphone array simulation system according to embodiments of the present disclosure.

This patent application relates to designing a simulation tool to simulate a microphone array and generate synthetic audio data to analyze the microphone array geometry. This reduces the development cost of new microphone arrays by enabling an evaluation of performance metrics (False Rejection Rate (FRR), Word Error Rate (WER), etc.) without building device hardware or collecting data. To generate the synthetic audio data, the system performs acoustic modeling to determine a room impulse response associated with a prototype device (e.g., potential microphone array) in a room. The acoustic modeling is based on two parameters—a device response (information about acoustics and geometry of the prototype device) and a room response (information about acoustics and geometry of the room). The device response can be simulated based on the microphone array geometry, and the room response can be determined using a special microphone and a plane wave decomposition algorithm. The simulation tool includes a database of room responses and can test the potential microphone array in different rooms simply by applying the device response to an individual room response FIG. 1 illustrates a microphone array simulation system according to embodiments of the present disclosure. Although FIG. 1, and other figures/discussion illustrate the operation of the system 100 in a particular order, the steps described may be performed in a different order (as well as certain steps removed or added) without departing from the intent of the disclosure.

As illustrated in FIG. 1, the system 100 may comprise one or more simulation device(s) 102, which may be communicatively coupled to network(s) 199 and/or other components of the system 100. Individually and/or collectively, the simulation device(s) 102 may be configured to perform a simulation of a microphone array. Thus, the system 100 may use one or more simulation device(s) 102 to perform the simulation and evaluate the microphone array. For example, as will be discussed in greater detail below, the system 100 may simulate a potential microphone array associated with a prototype device prior to actually building the prototype device, enabling the system 100 to evaluate a plurality of microphone array designs having different geometries and select a potential microphone array based on the simulated performance of the potential microphone array. However, the disclosure is not limited thereto and the system 100 may evaluate a single potential microphone array, an existing microphone array, and/or the like without departing from the disclosure.

As illustrated in FIG. 1, the system 100 may include a local simulation device 102*a* (e.g., simulation device 102 that is local to a user) and/or remote simulation device(s) 102*b* (e.g., simulation devices 102 included in a remote system 104 that is remote from the user). Therefore, the system 100 may perform a simulation of a potential microphone array using the local simulation device 102*a*, the remote simulation device(s) 102*b*, and/or a combination thereof. In some examples, the system 100 may perform the simulation on the local simulation device 102*a* independently from the remote system 104 (e.g., locally on the local simulation device 102*a* without communicating with the remote system 104). For example, the local simulation device 102*a* may include a self-contained simulation tool that operates locally on the local simulation device 102*a* using data stored in a local database. However, the disclosure is not limited thereto and the local simulation device 102*a* may communicate with the remote system 104 without departing from the disclosure. For example, the local simulation device 102*a* may request data from the remote system 104 but perform the simulation locally (e.g., operating the simulation tool using data received from the remote system 104 instead of from the local database) without departing from the disclosure.

While the examples described above refer to the local simulation device 102*a* performing the simulation locally, the disclosure is not limited thereto and the remote system 104 may perform at least a portion of the simulation without departing from the disclosure. For example, in some examples the local simulation device 102*a* may perform a first portion of the simulation and the remote system 104 may perform a second portion of the simulation. Thus, the simulation tool may be distributed across the system 100. Additionally or alternatively, the remote system 104 may perform the simulation remotely (e.g., the simulation tool operates only on the remote system 104). For example, in some examples the local simulation device 102*a* may send input data to the remote system 104 and the remote system 104 may perform the simulation remotely based on the input data. Thus, the local simulation device 102*a* may send parameters selected for the simulation to the remote system 104 and the remote system 104 may perform the simulation using the selected parameters and send corresponding output data back to the local simulation device 102*a*. However, the disclosure is not limited thereto and in other examples the remote system 104 may perform the simulation independently from the local simulation device 102*a* (e.g., the remote system 104 may perform the simulation without communicating with the local simulation device 102*a*) without departing from the disclosure.

As the simulation tool may be distributed across the system 100 (e.g., portions of the simulation tool may operate on the local simulation device 102*a* and/or the remote simulation device(s) 102*b*), for ease of explanation the disclosure may simply refer to the "device 102" performing actions associated with the simulation. However, the disclosure is not limited thereto and the actions may be performed by the local simulation device 102*a*, the remote simulation device(s) 102*b*, and/or a combination of the local simulation device 102*a* and the remote simulation device(s) 102*b* without departing from the disclosure.

In some examples, the remote system 104 may include multiple remote simulation devices 102*b*. Additionally or alternatively, the remote simulation device(s) 102*b* may correspond to a server. The term "server" as used herein may refer to a traditional server as understood in a server/client computing structure but may also refer to a number of different computing components that may assist with the operations discussed herein. For example, a server may include one or more physical computing components (such as a rack server) that are connected to other devices/components either physically and/or over a network and is capable of performing computing operations. A server may also include one or more virtual machines that emulates a computer system and is run on one or across multiple devices. A server may also include other combinations of hardware, software, firmware, or the like to perform operations discussed herein. The server(s) may be configured to operate using one or more of a client-server model, a computer bureau model, grid computing techniques, fog computing techniques, mainframe techniques, utility computing techniques, a peer-to-peer model, sandbox techniques, or other computing techniques.

The network(s) 199 may include a local or private network and/or may include a wide network such as the Internet. The device(s) 102 may be connected to the network(s) 199 through either wired or wireless connections. For example, the local simulation device 102*a* may be connected to the network(s) 199 through a wireless service provider, over a WiFi or cellular network connection, or the like. Other devices may be included as network-connected support devices, such as the remote simulation device(s) 102*b* included in the remote system 104, and may connect to the network(s) 199 through a wired connection and/or wireless connection without departing from the disclosure.

As is known and as used herein, "capturing" an audio signal and/or generating audio data includes a microphone transducing audio waves (e.g., sound waves) of captured sound to an electrical signal and a codec digitizing the signal to generate the microphone audio data.

As discussed above, the system 100 may perform a simulation of a microphone array in order to evaluate the microphone array. For example, the system 100 may simulate how the selected microphone array will capture audio in a particular room by estimating a room impulse response (RIR) corresponding to the selected microphone array being at a specific location in the room. A RIR corresponds to a system response of a system from its input and output-in this case, a point-to-point system response inside the room. For example, the input to the system (e.g., source signal, such as white noise) corresponds to output audio data used to generate output audio at a first location (e.g., position of a loudspeaker emitting the output audio), while the output of the system (e.g., target signal) corresponds to input audio data generated by the microphone array at a second location (e.g., individual positions of the microphones included in the microphone array capturing a portion of the output audio).

Typically, the RIR is estimated based on an actual physical measurement between a loudspeaker and the microphone array. For example, the output audio data is sent to the loudspeaker at the first location and the microphone array generates the input audio data at the second location. Before determining the RIR, the output audio data (e.g., playback signal $x_p(t)$) and the input audio data (e.g., microphone signal $y_m(t)$)), need to be aligned in both time and frequency, including adjusting for a frequency offset (e.g., clock frequency drift between different clocks), resampling the signals to have the same sampling frequency (e.g., 16 kHz, although the disclosure is not limited thereto), and/or adjusting to compensate for a time offset (e.g., determined as the index of a maximum cross correlation between the playback signal $x_p(t)$ and the microphone signal $y_m(t)$). After time-frequency alignment of the output audio data and the input audio data (e.g., generating aligned microphone signal $\tilde{y}_m(t)$), the system response $\{h(n)\}_{n=0}^{T}$ may be calculated using a cross-correlation as:

$$h(n)=\mathbb{E}\{x_p(t)\tilde{y}_m(t+n)\} \quad [1]$$

where h(n) is the system response (e.g., RIR), $\mathbb{E}$ indicates an expected value (e.g., probability-weighted average of outcome values), $x_p(t)$ is the playback signal (e.g., output audio data), $\tilde{y}_m(t)$ is the time-aligned microphone signal (e.g., input audio data). For microphone arrays, all the microphones are driven by the same clock. Therefore, the time-frequency alignment estimation procedure between the playback signal and the microphone signal only needs to be done with a single microphone and the alignment parameters may be applied to all microphones.

While the example above refers to determining the system response using a cross-correlation calculation, the disclosure is not limited thereto and the system 100 may estimate room impulse response data using any techniques known to one of skill in the art. For example, the system 100 may perform cross-spectrum analysis in the frequency domain, cross-correlation analysis in the time domain, determine an inter-channel response, and/or the like without departing from the disclosure.

To enable the system 100 to simulate the RIR for a selected microphone array without needing to physically measure the RIR using the selected microphone array, the system 100 may perform plane wave decomposition to separate the impact of room acoustics from the impact of device scattering associated with a microphone array. For example, the system 100 may perform the steps described above to physically measure the RIR for a room using a known microphone array.

Acoustic theory tells us that a point source produces a spherical acoustic wave in an ideal isotropic (uniform) medium such as air. Further, the sound from any radiating surface can be computed as the sum of spherical acoustic wave contributions from each point on the surface, including any relevant reflections. In addition, acoustic wave propagation is the superposition of spherical acoustic waves generated at each point along a wavefront. Thus, all linear acoustic wave propagation can be seen as a superposition of spherical traveling waves.

Figure 2B:
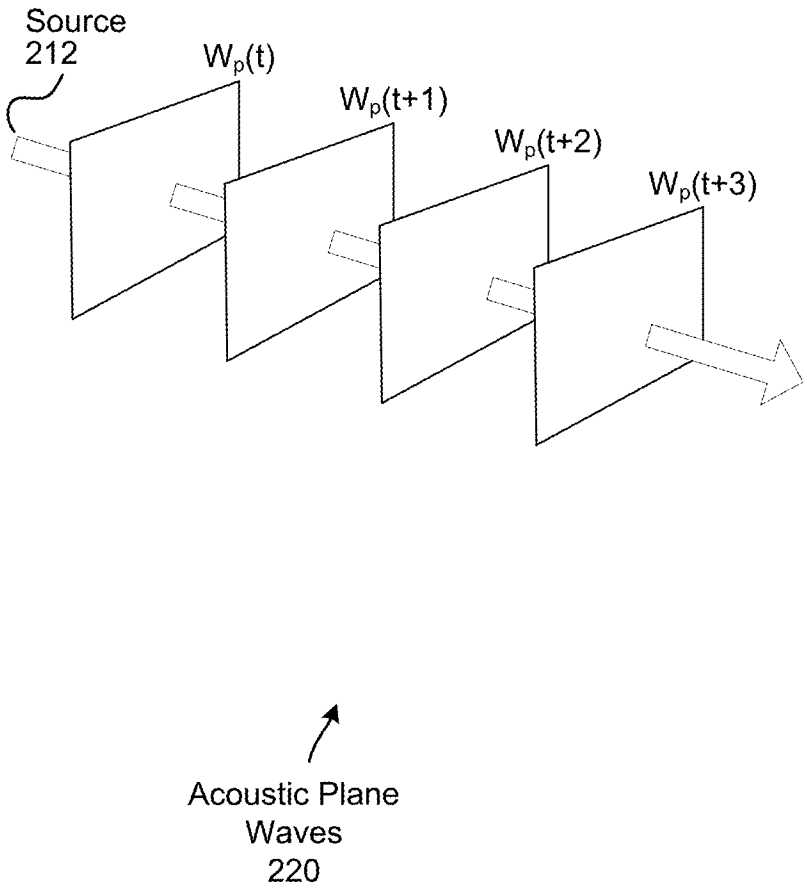
FIGS. 2A-2B illustrate examples of acoustic wave propagation.
Figure 2A:
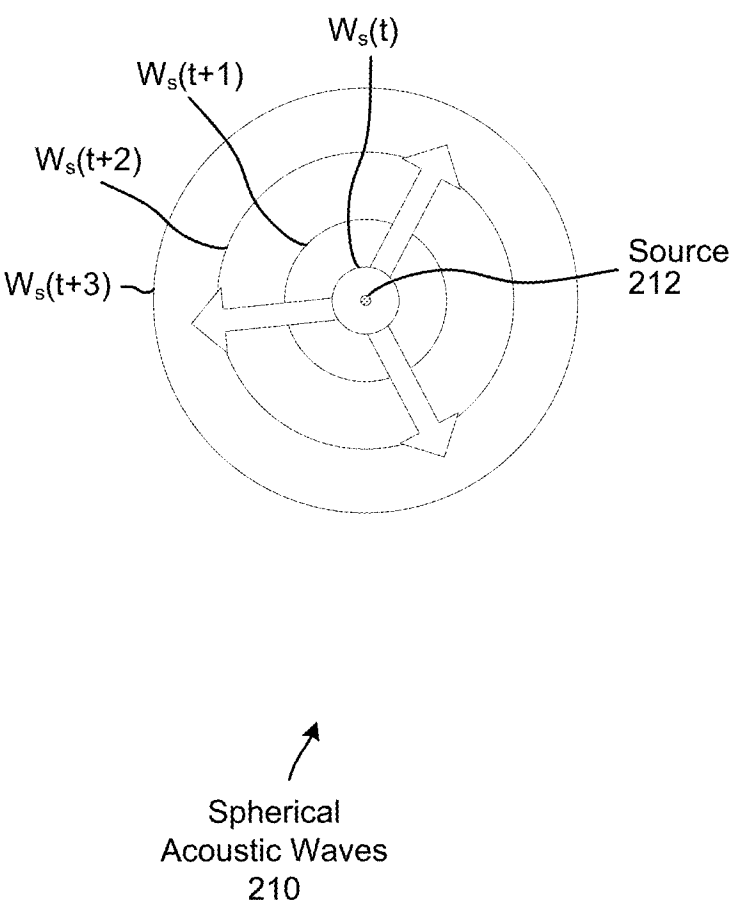

FIGS. 2A-2B illustrate examples of acoustic wave propagation. As illustrated in FIG. 2A, spherical acoustic waves 210 (e.g., spherical traveling waves) correspond to a wave whose wavefronts (e.g., surfaces of constant phase) are spherical (e.g., the energy of the wavefront is spread out over a spherical surface area). Thus, the source 212 (e.g., radiating sound source, such as a loudspeaker) emits spherical traveling waves in all directions, such that the spherical acoustic waves 210 expand over time. This is illustrated in FIG. 2A as a spherical wave $w_s$ with a first arrival having a first radius at a first time $w_s(t)$, a second arrival having a second radius at a second time $w_s(t+1)$, a third arrival having a third radius at a third time $w_s(t+2)$, a fourth arrival having a fourth radius at a fourth time $w_s(t+3)$, and so on.

Additionally or alternatively, acoustic waves can be visualized as rays emanating from the source 212, especially at a distance from the source 212. For example, the acoustic waves between the source 212 and the microphone array can be represented as acoustic plane waves. As illustrated in FIG. 2B, acoustic plane waves 220 (e.g., planewaves) correspond to a wave whose wavefronts (e.g., surfaces of constant phase) are parallel planes. Thus, the acoustic plane waves 220 shift with time t from the source 212 along a direction of propagation (e.g., in a specific direction), represented by the arrow illustrated in FIG. 2B. This is illustrated in FIG. 2B as a plane wave $w_p$ having a first position at a first time $w_p(t)$, a second position at a second time $w_p(t+1)$, a third position at a third time $w_p(t+2)$, a fourth position at a fourth time $w_p(t+3)$, and so on. While not illustrated in FIG. 2B, acoustic plane waves may have a constant value of magnitude and a linear phase, corresponding to a constant acoustic pressure.

Acoustic plane waves are a good approximation of a far-field sound source (e.g., sound source at a relatively large distance from the microphone array), whereas spherical acoustic waves are a better approximation of a near-field sound source (e.g., sound source at a relatively small distance from the microphone array). For ease of explanation, the disclosure may refer to acoustic waves with reference to acoustic plane waves. However, the disclosure is not limited thereto, and the illustrated concepts may apply to spherical acoustic waves without departing from the disclosure. For example, the device acoustic characteristics data may correspond to acoustic plane waves, spherical acoustic waves, and/or a combination thereof without departing from the disclosure.

Figure 3:
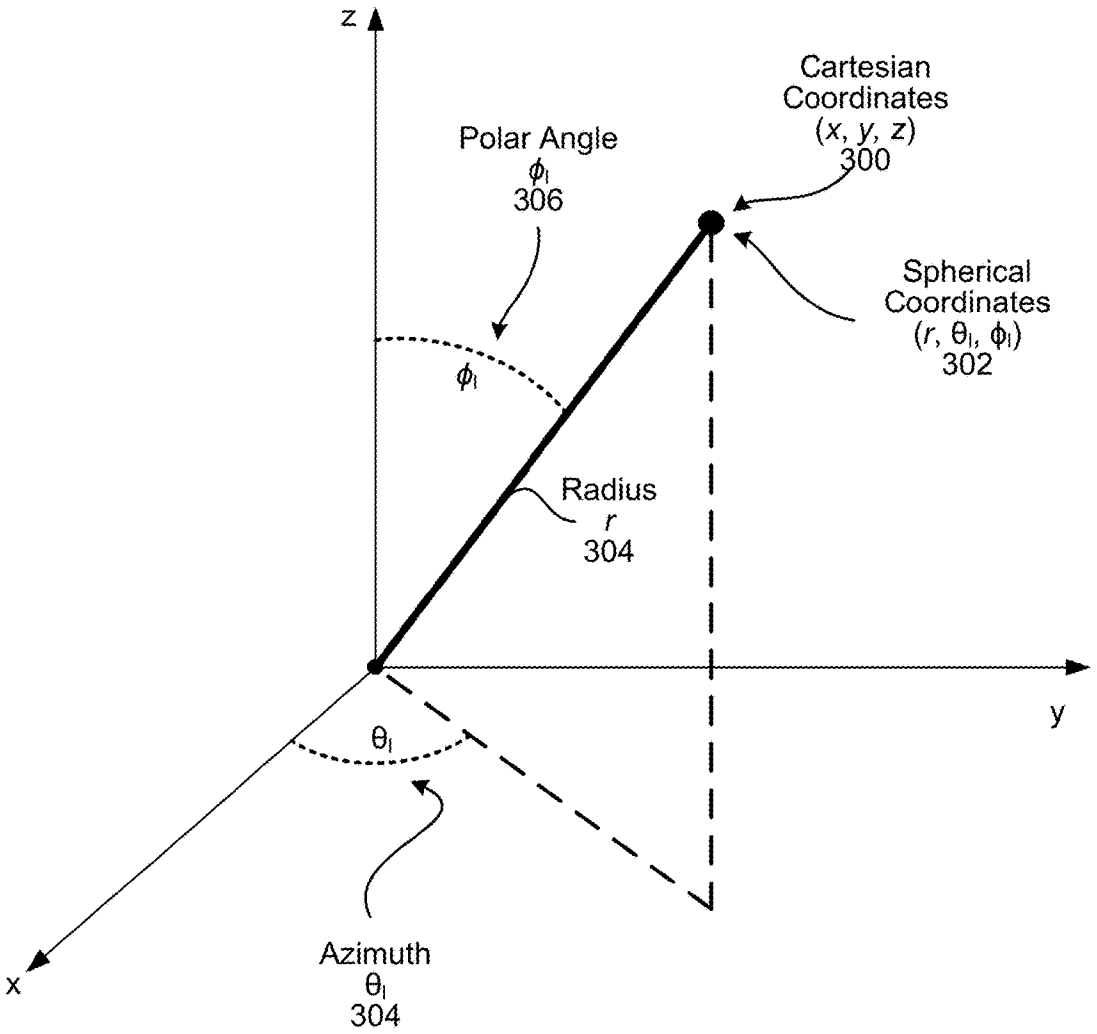
FIG. 3 illustrates an example of spherical coordinates.

FIG. 3 illustrates an example of spherical coordinates, which may be used throughout the disclosure with reference to acoustic waves relative to the microphone array. As illustrated in FIG. 3, Cartesian coordinates (x, y, z) 300 correspond to spherical coordinates (r, $\theta_l$, $\phi_l$) 302. Thus, using Cartesian coordinates, a location may be indicated as a point along an x-axis, a y-axis, and a z-axis using coordinates (x, y, z), whereas using spherical coordinates the same location may be indicated using a radius r 304, an azimuth $\theta_l$ 306 and a polar angle $\phi_l$ 308. The radius r 304 indicates a radial distance of the point from a fixed origin, the azimuth $\theta_l$ 306 indicates an azimuth angle of its orthogonal projection on a reference plane that passes through the origin and is orthogonal to a fixed zenith direction, and the polar angle $\phi_l$ 308 indicates a polar angle measured from the fixed zenith direction. Thus, the azimuth $\theta_l$ 306 varies between 0 and 360 degrees, while the polar angle $\phi_l$ 308 varies between 0 and 180 degrees.

Referring back to FIG. 1, a room impulse response (RIR) database 110 may receive room acoustic characteristics data 112 and device acoustic characteristics data 114 and generate RIR data 116. For example, during simulation the system 100 may input the device acoustic characteristics data 114 corresponding to a potential microphone array, select a particular room to simulate, retrieve room acoustic characteristics data 112 associated with the room, and generate the RIR data 116. The room acoustic characteristics data 112 may be previously calculated, although the disclosure is not limited thereto and the system 100 may determine the room acoustic characteristics data 112 during the simulation.

The RIR database 110 may send the RIR data 116 to synthetic microphone audio data generator 120, which may generate synthetic microphone audio data 124. For example, the synthetic microphone audio data generator may receive speech audio data 132 from a speech database 130, along with text data 134 corresponding to the speech audio data 132, and may modify the speech audio data 132 based on the RIR data 116. Similarly, the synthetic microphone audio data generator 120 may receive noise audio data 142 from a noise database 140 and may modify the noise audio data 142 based on the RIR data 116. In addition, the synthetic microphone audio data generator 120 may receive signal-to-noise ratio (SNR) data 122 and may use the SNR data 122 to adjust the modified noise audio data based on the desired SNR (e.g., vary an amplitude of the noise audio data relative to an amplitude of the speech audio data).

The synthetic microphone audio data generator 120 may combine the modified speech audio data and the modified noise audio data to generate the synthetic microphone audio data 124. In some examples, the synthetic microphone audio data generator 120 may optionally send the synthetic microphone audio data 124, along with the text data 134, to statistics generator 150 and the statistics generator 150 may generate a final report 152. The statistics generator 150 is represented using a dashed line, indicating that this is an optional component, and that the disclosure is not limited thereto. The final report may indicate performance parameters or other information about the microphone array based on an analysis of the synthetic microphone audio data 124. For example, the system 100 may perform speech processing on the synthetic microphone audio data 124 to generate second text data and may compare the second text data to the text data 134 and determine performance parameters such as false rejection rate (FRR), word error rate (WER), and/or the like. Additionally or alternatively, the statistics generator 150 may evaluate the synthetic microphone audio data 124 using any technique known to one of skill in the art. While FIG. 1 illustrates the synthetic microphone audio data generator 120 directly sending the synthetic microphone audio data 124 to the statistics generator 150, the disclosure is not limited thereto and the system 100 may include additional components not illustrated in FIG. 1. For example, the system 100 may process the synthetic microphone audio data 124 using additional components prior to the statistics generator 150, such as an acoustic front end component, beamformer component(s), speech processing component (s), a wakeword engine, and/or the like.

FIG. 1 includes a flowchart conceptually illustrating an example method for evaluating a microphone array using a simulation, as described in greater detail above. As illustrated in FIG. 1, the system 100 may determine (160) room acoustic characteristics data corresponding to a room, determine (162) device acoustic characteristics data corresponding to the microphone array, and estimate (164) room impulse response (RIR) data corresponding to both the room and the microphone array. The system 100 may then generate (166) synthetic microphone audio data using the RIR data and may generate (168) a report associated with the microphone array. While FIG. 1 illustrates step 160 occurring prior to step 162, the disclosure is not limited thereto. Thus, the system 100 may determine (162) device acoustic characteristics data and then determine (160) room acoustic characteristics data without departing from the disclosure.

Figure 4:
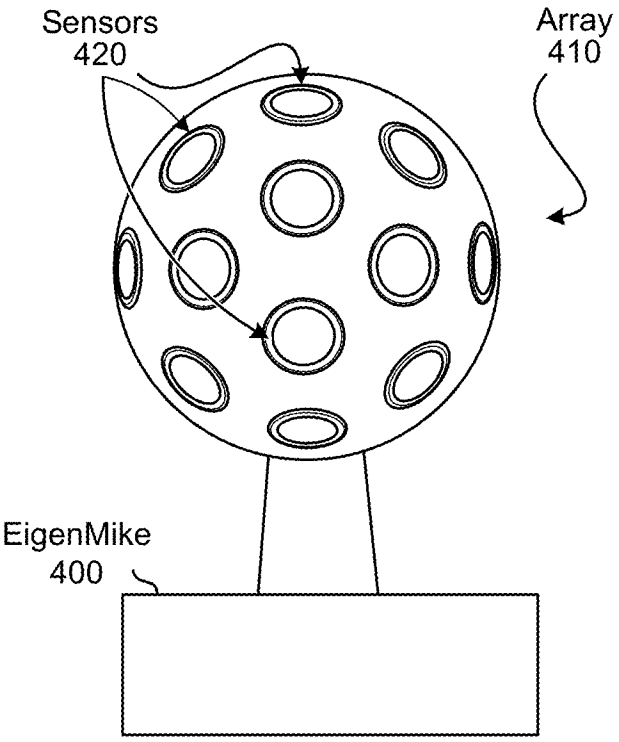
FIG. 4 illustrates an example of a special microphone array used to perform plane wave decomposition according to embodiments of the present disclosure.

FIG. 4 illustrates an example of a special microphone array used to perform plane wave decomposition according to embodiments of the present disclosure. In order to improve an accuracy in the modeling of the acoustic wave-field in a typical room, a relatively large number (e.g., ≥20) of plane waves are needed. Therefore, a microphone array with a large number of microphones is needed to avoid overfitting. As illustrated in FIG. 4, an EigenMike 400 may be used to model the acoustic wave-field. For example, the EigenMike 400 may include a spherical array 410 of sensors 420, such as a plurality of microphones (e.g., 32). While FIG. 4 illustrates an example of a particular microphone (e.g., EigenMike 400), the disclosure is not limited thereto and the system 100 may model the acoustic wave-field using other microphones (e.g., without using the EigenMike 400) without departing from the disclosure. For example, the system 100 may use a spherical microphone array and/or other geometries, which may be referred to as a test microphone, without departing from the disclosure.

Figure 5:
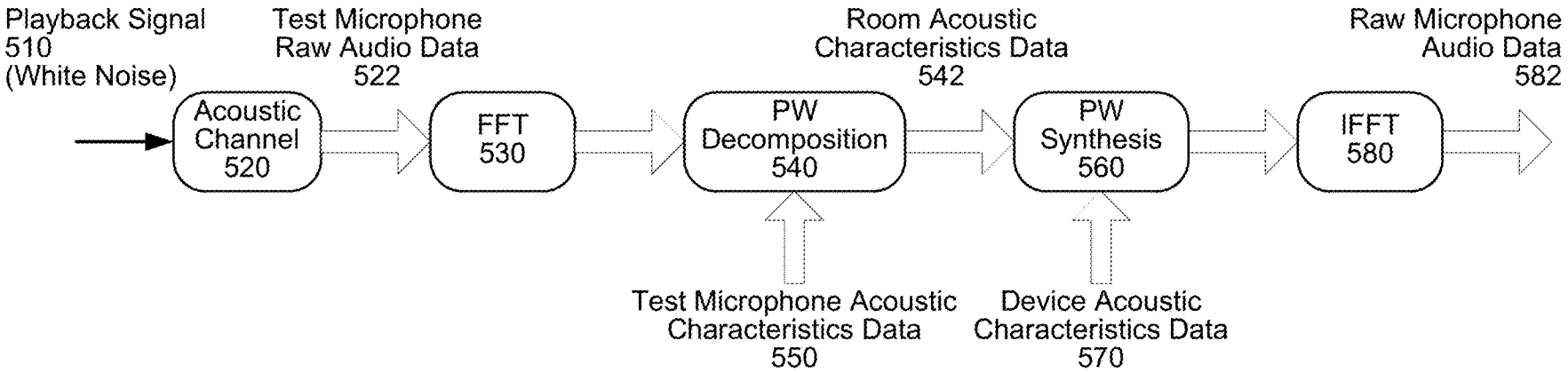
FIG. 5 illustrates an example of generating synthetic microphone audio data according to embodiments of the present disclosure.

FIG. 5 illustrates an example of generating synthetic microphone audio data according to embodiments of the present disclosure. As described above, the system 100 may simulate the room impulse response (RIR) of a room with a simulated microphone array by generating synthetic microphone audio data based on room acoustic characteristics data 112 and device acoustic characteristics data 114.

To determine the room acoustic characteristics data 112, the system 100 may physically generate an audible sound (e.g., white noise) using a loudspeaker in a room and capture the audible sound using a test microphone array, which may be a spherical microphone array such as the EigenMike 400 illustrated in FIG. 4. For example, the system 100 may send a playback signal to the loudspeaker and capture a playback signal 510 corresponding to white noise using the test microphone array. Thus, each acoustic channel 520 may generate test microphone raw audio data 522 corresponding to the playback signal sent to the loudspeaker.

The system 100 may perform Fast Fourier Transform (FFT) processing on the test microphone raw audio data 522 to convert from a time domain to a frequency domain and may perform plane wave decomposition 540, using a test microphone acoustic characteristics data 550, as described in greater detail above. Thus, the output of the PW decomposition 540 corresponds to room acoustic characteristics data 542 associated with the room.

To generate the raw microphone audio data 590, the system 100 needs to determine device acoustic characteristics data 570 associated with the simulated microphone array, as described in greater detail below with regard to FIGS. 6A-6B. As illustrated in FIG. 5, the system 100 may retrieve the device acoustic characteristics data 570 and perform plane wave synthesis 560. For example, the system 100 may combine the room acoustic characteristics data 542 with the device acoustic characteristics data 570 to generate the synthetic microphone audio data in the frequency domain and then perform inverse FFT (IFFT) processing 580 to convert from the frequency domain to the time domain and generate raw microphone audio data 582. As described above, the system 100 may then determine the estimated RIR associated with the simulated microphone array by comparing the raw microphone audio data 582 to the playback audio data sent to the loudspeaker.

As illustrated in FIG. 5, the system 100 effectively replaces test microphone acoustic characteristics data 550 with the device acoustic characteristics data 570 to generate the raw microphone audio data 582. For example, the test microphone array performs an actual measurement to generate the test microphone raw audio data 522 during anechoic conditions, but this measurement is inherently affected by scattering due to a surface of the test microphone array itself. Thus, the test microphone raw audio data 522 represents a total wave-field, which is a sum of both incident plane waves and a scattered wave-field caused by scattering due to the surface of the test microphone array. By performing plane wave decomposition 540 using the test microphone acoustic characteristics data 550, the system 100 compensates for this scattering and determines room acoustic characteristics data 542 that isolates the incident plane waves. Then, by performing plane wave synthesis 560 using the device acoustic characteristics data 570 and the room acoustic characteristics data 542, the system 100 estimates scattering due to a surface associated with the simulated microphone array and generates the raw microphone audio data 582 based on a sum of the incident plane waves and the estimated scattering.

Device acoustic characteristics data associated with a microphone array (e.g., test microphone acoustic characteristics data 550 associated with a test microphone array and the device acoustic characteristics data 570 associated with a simulated microphone array) may include a plurality of vectors, with a single vector corresponding to a single acoustic wave. The number of acoustic waves may vary, and in some examples the acoustic characteristics data may include acoustic plane waves, spherical acoustic waves, and/or a combination thereof.

The entries (e.g., values) for a single vector represent an acoustic pressure indicating a total field at each microphone (e.g., incident acoustic wave and scattering caused by the microphone array) for a particular background acoustic wave. These values may be directly measured using a physical measurement in an anechoic room with a distance point source (e.g., loudspeaker), or may be simulated by solving a Helmholtz equation, as described below with regard to FIGS. 6A-6B. For example, using techniques such as finite element method (FEM), boundary element method (BEM), finite difference method (FDM), and/or other techniques known to one of skill in the art, the system 100 may calculate the total wave-field at each microphone. Thus, a number of entries in each vector corresponds to a number of microphones in the microphone array, with a first entry corresponding to a first microphone, a second entry corresponding to a second microphone, and so on.

To determine the room impulse response (RIR) itself, the system 100 may compare the raw microphone audio data 582 to the playback signal 510. Thus, the RIR represents a system response between the first location of the loudspeaker and a second location of the test microphone array. The system 100 may determine the RIR using cross-correlation analysis in the time domain, cross-spectrum analysis in the frequency domain, and/or using any techniques known to one of skill in the art.

Changing an angle of the acoustic wave is equivalent to rotating the simulated device associated with a microphone array in place. For example, rotating angles by 5 degrees is equivalent to rotating the simulated device by 5 degrees. Thus, using the room acoustic characteristics data 542 and the device acoustic characteristics data 570, the system 100 may generate an infinite number of combinations, which modifies the resulting raw microphone audio data 582. However, the room acoustic characteristics data 542 is specific to a certain configuration between the loudspeaker and the test microphone array, meaning that a first location of the loudspeaker and a second location of the test microphone array is fixed. Thus, each recording (e.g., test microphone raw audio data 522) corresponds to a single configuration.

The system 100 may perform multiple recordings for a single room depending on a desired simulation scenario. For example, the system 100 may perform nine separate recordings for a single room, placing the test microphone array in typical conditions such as i) in the open (e.g., away from all walls), ii) near a single wall, iii) in a corner (e.g., near two walls), iv) in a cabinet (e.g., enclosed on all sides), and so on. Thus, during simulation the system 100 may select the room acoustic characteristics data 542 that match a desired configuration of the simulated microphone array (e.g., user selects likely scenario for the simulated microphone array and the system 100 selects a room acoustic characteristics data 542 corresponding to the likely scenario).

The device 110 may calculate the room impulse response (RIR) by solving the acoustic wave equation, which is the governing law for acoustic wave propagation in fluids, including air. In the time domain, the homogenous wave equation has the form:

$$\nabla^2 \bar{p} - \frac{1}{c^2}\frac{\partial^2 \bar{p}}{\partial t^2} = 0 \qquad [2a]$$

where p(t) is the acoustic pressure and c is the speed of sound in the medium. Alternatively, the acoustic wave equation may be solved in the frequency domain using the Helmholtz equation to find p(f):

$$\nabla^2 p + k^2 p = 0 \qquad [2b]$$

where $k \triangleq 2\pi f/c$ is the wave number. At steady state, the time-domain and the frequency-domain solutions are Fourier pairs. The boundary conditions are determined by the geometry and the acoustic impedance of the difference boundaries. The Helmholtz equation is typically solved using Finite Element Method (FEM) techniques, although the disclosure is not limited thereto and the device 110 may solve using boundary element method (BEM), finite difference method (FDM), and/or other techniques known to one of skill in the art.

While calculating the direct solution of the Helmholtz equation using FEM techniques is complicated, the device 110 may simulate the RIR using Plane Wave Decomposition (PWD). For example, the device 110 may decompose the RIR into two components; the room component, and the device surface component. The room component is computed by approximating the wave-field at any point inside a room as a superposition of acoustic plane waves. The device surface component is computed by simulating the scattered acoustic pressure at each microphone on the device for each acoustic plane wave. The total acoustic pressure at each microphone on the device surface is computed by combining the plane wave representation of the wave-field with the device response to each plane wave. The methodology has three components:

1. Dictionary: Build a dictionary of acoustic pressure vectors for the device under test. The vectors in the dictionary represent the anechoic response of the microphone array to spherical/plane acoustic waves.
2. Decomposition: Decompose the wave-field at a point inside the room to plane (and spherical) acoustic waves, using a special microphone array with a large number of microphones
3. Reconstruction: Reconstruct the wave-field at the device under test, from the wave decomposition in step 2 and using the dictionary of step 1.

The acoustic pressure of a plane-wave with vector wave number k is defined at a point r=x,y,z) in the three-dimensional (3D) space as:

$$p(k) \triangleq p_0 e^{-jk^T r} \qquad [3]$$

where k is the three-dimensional wavenumber vector. For free space propagation, k has the form:

$$k(f, \theta, \phi) = \frac{2\pi f}{c}\begin{pmatrix} \cos(\theta)\sin(\phi) \\ \sin(\theta)\sin(\phi) \\ \cos(\phi) \end{pmatrix} \qquad [4]$$

where c is the speed of sound, θ and ϕ are respectively the azimuth and elevation of the vector normal to the plane wave (i.e., a vector along the propagation direction). Denote the wavenumber amplitude as:

$$k \triangleq \|k\| \qquad [5]$$

The plane-wave in (3) is a solution of the inhomogenous Helmholtz equation with a far point source. A general solution to the homogenous Helmholtz equation can be approximated by a linear superposition of plane waves of difference angles of the form [6,7]:

$$p_i(f) = \sum_{l=1}^{N} \alpha_l p(k_l(f, \theta_l, \phi_l)) \qquad [6]$$

Where each $p(k_l)$ is a plane wave as in (3), $k_l$ is as in (4), and $\{\alpha_l\}$ are complex scaling factors. We will refer to the wave-field in (6) as the overall background acoustic pressure. The decision variables are $\{N, \{\alpha_l, \theta_l, \phi_l\}_l\}$. Note that the solution in (6) always satisfies the homogenous Helmholtz equation (2) for any choice of the decision variables, which are chosen to satisfy the boundary conditions.

The plane wave expansion in (6) provides a general expression of the acoustic wave-field at any point (x,y,z) inside the room. If a device, with plane-wave dictionary $D=\{p_t(f_0,\theta_l,\phi_l)\}$, and a microphone array placed at (x,y,z), then from the linearity of the wave equation, the observed acoustic pressure vector, at frequency $f_0$, at the microphones of the microphone array is:

$$p_a(f_0) = \sum_{l=1}^{N} \alpha_l p_t(f_0, \theta_l, \phi_l) \quad [7]$$

The device 110 may use a narrowband plane wave decomposition (PWD) to determine parameters $\hat{\eta}=\{N, \{\alpha_l, \theta_l, \phi_l\}_{l=1}^{N}\}$ in (7) at frequency f0 that best approximates an observed wave-field pm(f0) at all microphones. In other words, the device 110 may minimize some loss function $J(\eta|p_m(f_0))$, where the best choice is:

$$\hat{\eta}=\text{argmin } J(\eta|p_m(f_0)) \quad [8]$$

The device 110 may use L2-Norm minimization with L2-regularization, and the objective function has the form:

$$J(\eta) = \left\| p_m(f_0) - \sum_{l=1}^{N} a_l p_t(f_0, \theta_l, \phi_l) \right\|^2 + \mu \sum_{l=1}^{N} \|\alpha_l\|^2 \quad [9]$$

where {pt(.)} is the plane-wave dictionary of the test microphone array (e.g., EigenMike). The regularization term is added to prevent overfitting if N is large. In practice, the device 110 may use 20 plane waves for wave-field approximation, but the disclosure is not limited thereto.

The PWD problem in (9) is a standard subset selection problem [8], which aims at representing an observed signal as a linear combination of a subset of vectors from an overcomplete dictionary of the signal space. To solve this problem, the device 110 may use a variation of the Orthogonal Matching Pursuit (OMP) algorithm.

The device 110 may perform a wideband plane-wave decomposition (PWD) algorithm to have consistent plane-wave directions along all frequencies. For example, the regularized objective function may be expressed as:

$$J(\eta) = \sum_{i \in \mathcal{F}} \left\| p_m(f_i) - \sum_{l=1}^{N} a_{i,l} p_t(f_i, \theta_l, \phi_l) \right\|^2 + \mu \sum_{i \in \mathcal{F}} \sum_{l=1}^{N} \|\alpha_{i,l}\|^2 \quad [10]$$

where $\alpha_{i,1}$ is the contribution of plane-wave with direction $(\theta_l, \phi_l)$ at frequency $f_i$, and $\mathcal{F}$ is the set of frequencies of interest. In this configuration, a single set of directions is used at all frequencies of interest. The wideband spectrum is split into non-overlapping sets of frequencies, and a single expansion is used for each.

Figure 6A:
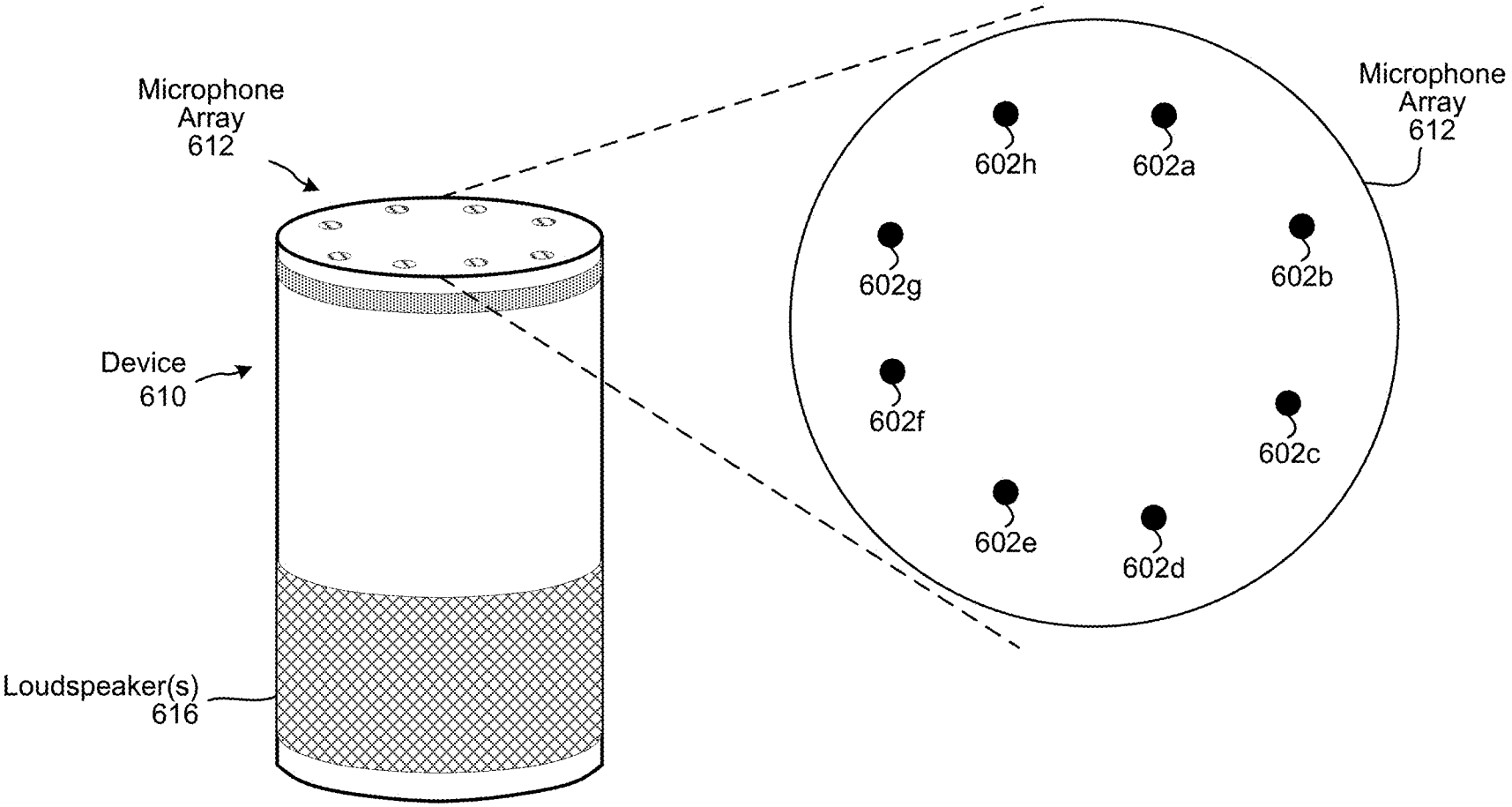
FIG. 6A-6B illustrate a microphone array and a corresponding mesh according to embodiments of the present disclosure.
Figure 6B:
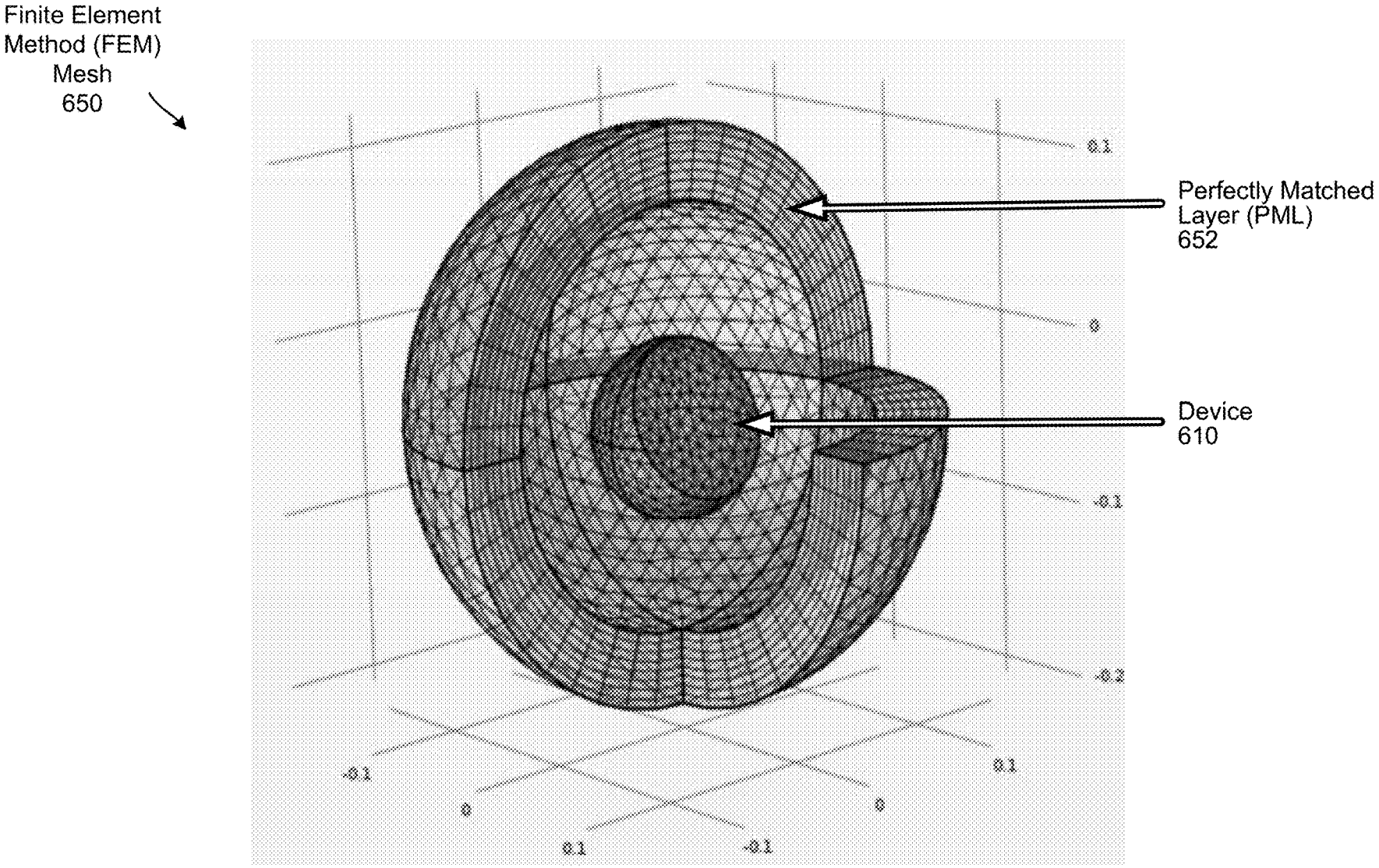

FIG. 6A-6B illustrate a microphone array to simulate and a corresponding mesh according to embodiments of the present disclosure. As illustrated in FIG. 6A, a device 610 may include, among other components, a microphone array 612, one or more loudspeaker(s) 616, and other components not illustrated in FIG. 6A. The microphone array 612 may include a number of different individual microphones 602. In the example configuration of FIG. 6A, the microphone array 612 includes eight (8) microphones, 602*a*-602*h*. To analyze the microphone array 612 using the simulation tools described herein, the system 100 may determine device acoustic characteristics data 114 associated with the device 610. For example, the device acoustic characteristics data 114 represents scattering due to the device surface.

Therefore, the system 100 needs to compute the scattered field at all microphones 602 for each plane-wave of interest impinging on a surface of the device 610. The total wave-field at each microphone of the microphone array 612 when an incident plane-wave $p_i(k)$ impinges on the device 610 has the general form:

$$p_t = p_i + p_s \quad [11]$$

where $p_t$ is the total wave-field, $p_i$ is the incident plane-wave, and $p_s$ is the scattered wave-field.

To determine the device acoustic characteristics data 114, the system 100 may simulate the microphone array 612 using a finite element method (FEM) mesh 650, illustrated in FIG. 6B. To mimic an open-ended boundary, the system 100 may use a perfectly matched layer (PML) 652 to define a special absorbing domain that eliminates reflection and refractions in the internal domain that encloses the device 610. While FIG. 6 illustrates using FEM processing, the disclosure is not limited thereto and the system 100 may use boundary element method (BEM) processing and/or any other technique known to one of skill in the art without departing from the disclosure.

Figure 7:
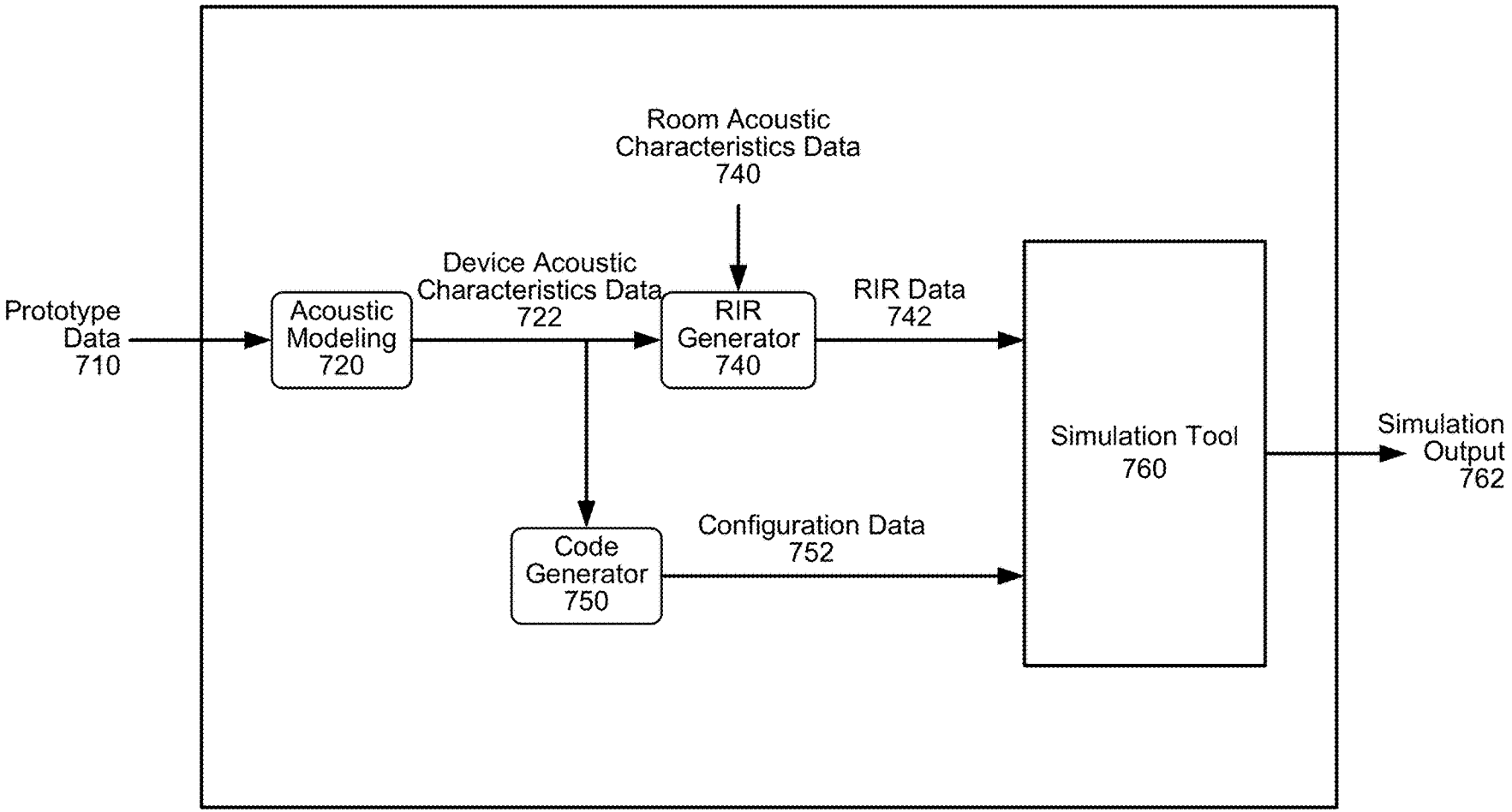
FIG. 7 illustrates an example of performing a simulation of a microphone array according to embodiments of the present disclosure.

FIG. 7 illustrates an example of performing a simulation of a microphone array according to embodiments of the present disclosure. As illustrated in FIG. 7, prototype data 710, such as computer-aided design (CAD) data, corresponds to a model of a device to be simulated. The system 100 may perform acoustic modeling 720 on the prototype data 710 to determine device acoustic characteristics data 722.

As described above with regard to FIG. 5, the system 100 may generate room acoustic characteristics data 730 for a particular room. During the simulation, a room impulse response (RIR) generator 740 may receive the room acoustic characteristics data 740 and generate data RIR 742 corresponding to the simulated microphone array in the particular room.

A code generator 750 may also receive the device acoustic characteristics data 722 and generate configuration data 752. A simulation tool 760 may receive the RIR data 742 and the configuration data 752 and perform a simulation to generate simulation output 762.

Figure 8:
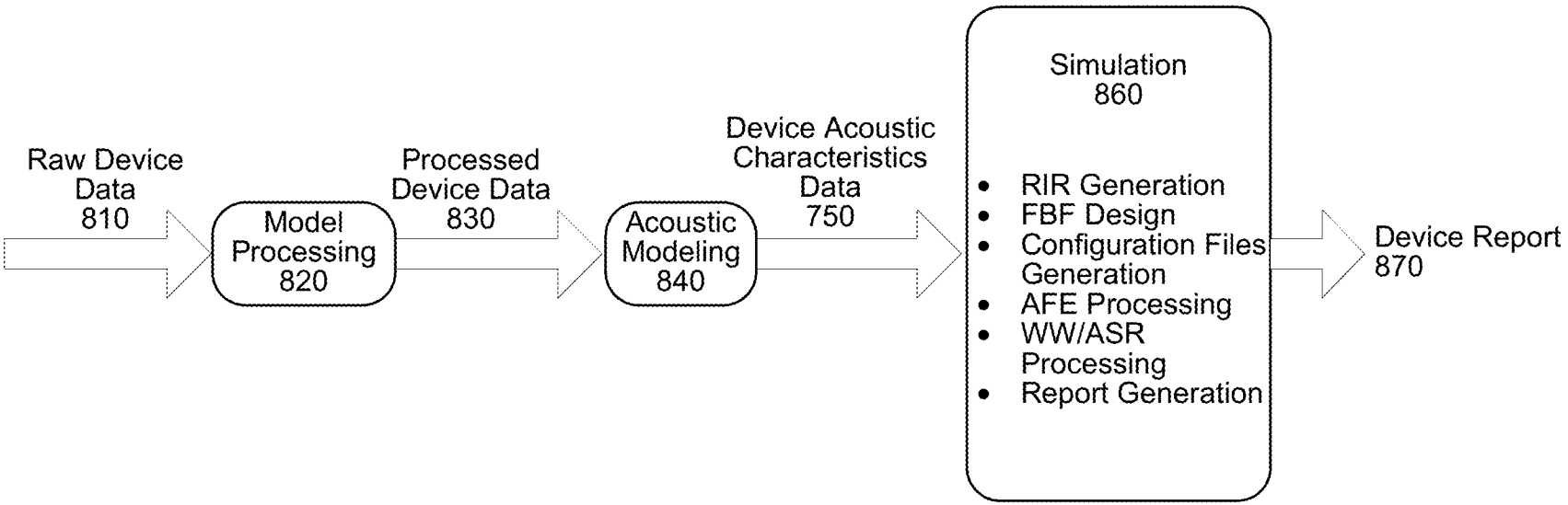
FIG. 8 illustrates an example of performing a simulation and generating a device report according to embodiments of the present disclosure.

FIG. 8 illustrates an example of performing a simulation and generating a device report according to embodiments of the present disclosure. As illustrated in FIG. 8, the system 100 may receive raw device data 810 and perform model processing 820 to generate processed device data 830. The system 100 may perform acoustic modeling 840 on the processed device data 830 to generate device acoustic characteristics data (e.g., device dictionary). The system 100 may then perform a simulation 860, as described in greater detail above, to generate a device report 870. For example, the simulation 860 may correspond to room impulse response (RIR) generation, fixed beamformer (FBF) design, configuration files generation, audio front end (AFE) processing, wakeword (WW) and/or automatic speech recognition (ASR) processing, report generation, and/or the like.

Figure 9A:
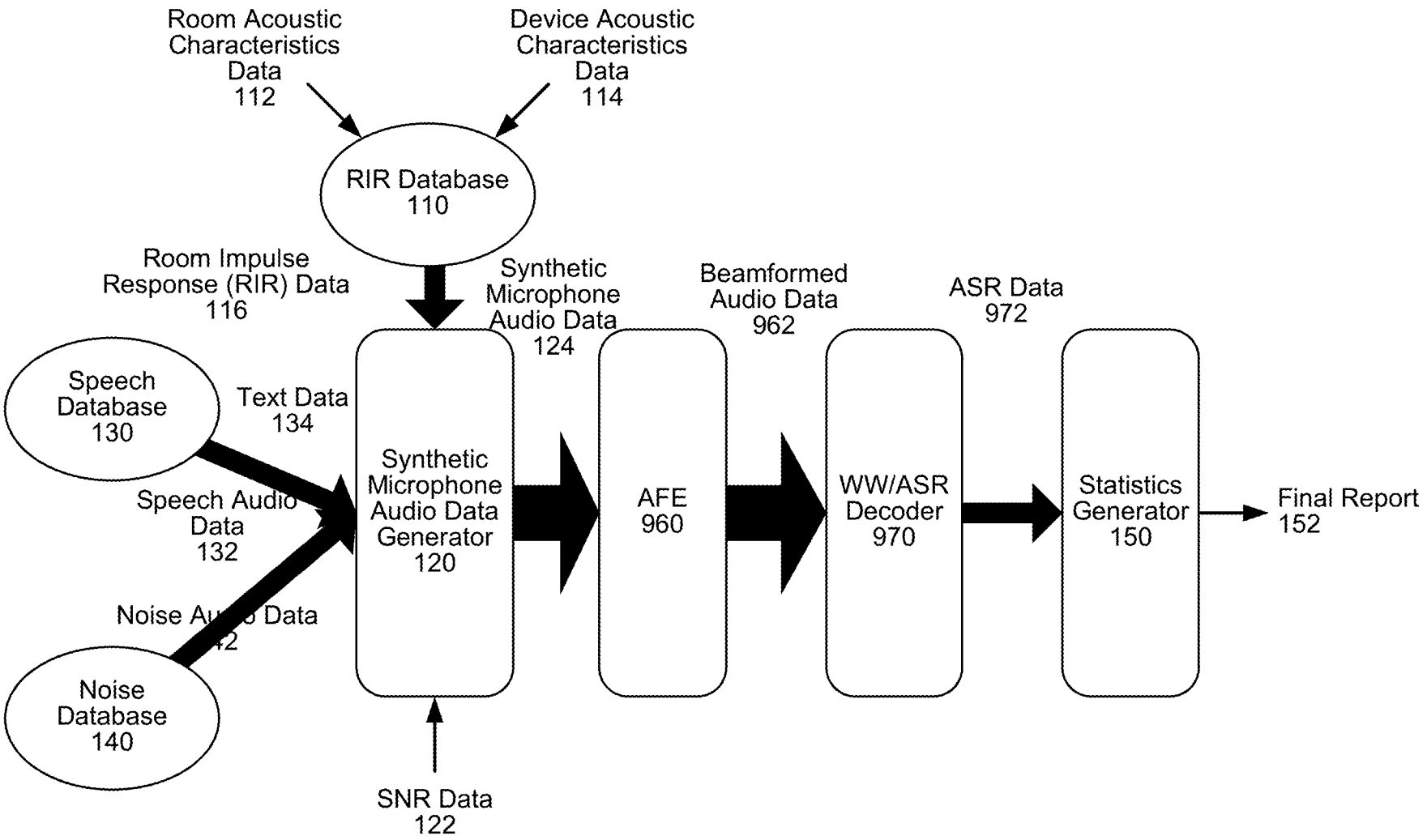
FIGS. 9A-9B illustrate examples of performing simulations of a microphone array according to embodiments of the present disclosure.

FIG. 9A illustrate examples of performing simulations of a microphone array according to embodiments of the present disclosure. For ease of illustration, descriptions of the components illustrated in FIGS. 9A-9B that were previously described with regard to FIG. 1 are omitted. FIG. 9A expands on FIG. 1 by illustrating examples of how the synthetic microphone audio data 124 may be processed prior to the statistics generator 150. For example, the system 100 may include an audio front end (AFE) 960 as well as a wakeword (WW) and/or automatic speech recognition (ASR) decoder 970.

As illustrated in FIG. 9A, the AFE 960 may receive the synthetic microphone audio data 124 and perform audio processing, including beamforming, to generate beamformed audio data 962. In audio systems, beamforming refers to techniques that are used to isolate audio from a particular direction in a multi-directional audio capture system. Beamforming may be particularly useful when filtering out noise from non-desired directions. Beamforming may be used for various tasks, including isolating voice commands to be executed by a speech-processing system.

One technique for beamforming involves boosting audio received from a desired direction while dampening audio received from a non-desired direction. In one example of a beamformer system, a fixed beamformer unit employs a filter-and-sum structure to boost an audio signal that originates from the desired direction (sometimes referred to as the look-direction) while largely attenuating audio signals that original from other directions. A fixed beamformer unit may effectively eliminate certain diffuse noise (e.g., undesirable audio), which is detectable in similar energies from various directions, but may be less effective in eliminating noise emanating from a single source in a particular non-desired direction. The beamformer unit may also incorporate an adaptive beamformer unit/noise canceller that can adaptively cancel noise from different directions depending on audio conditions.

As discussed above, the device 110 may perform beamforming (e.g., perform a beamforming operation to generate beamformed audio data corresponding to individual directions). As used herein, beamforming (e.g., performing a beamforming operation) corresponds to generating a plurality of directional audio signals (e.g., beamformed audio data) corresponding to individual directions relative to the microphone array. For example, the beamforming operation may individually filter input audio signals generated by multiple microphones in the microphone array 114 (e.g., first audio data associated with a first microphone, second audio data associated with a second microphone, etc.) in order to separate audio data associated with different directions. Thus, first beamformed audio data corresponds to audio data associated with a first direction, second beamformed audio data corresponds to audio data associated with a second direction, and so on. In some examples, the device 110 may generate the beamformed audio data by boosting an audio signal originating from the desired direction (e.g., look direction) while attenuating audio signals that originate from other directions, although the disclosure is not limited thereto.

These directional calculations may sometimes be referred to as "beams" by one of skill in the art, with a first directional calculation (e.g., first filter coefficients) being referred to as a "first beam" corresponding to the first direction, the second directional calculation (e.g., second filter coefficients) being referred to as a "second beam" corresponding to the second direction, and so on. Thus, the device 110 stores hundreds of "beams" (e.g., directional calculations and associated filter coefficients) and uses the "beams" to perform a beamforming operation and generate a plurality of beamformed audio signals. However, "beams" may also refer to the output of the beamforming operation (e.g., plurality of beamformed audio signals). Thus, a first beam may correspond to first beamformed audio data associated with the first direction (e.g., portions of the input audio signals corresponding to the first direction), a second beam may correspond to second beamformed audio data associated with the second direction (e.g., portions of the input audio signals corresponding to the second direction), and so on. For ease of explanation, as used herein "beams" refer to the beamformed audio signals that are generated by the beamforming operation. Therefore, a first beam corresponds to first audio data associated with a first direction, whereas a first directional calculation corresponds to the first filter coefficients used to generate the first beam.

The WW/ASR decoder 970 may analyze the beamformed audio data 962 to generate ASR data 972. A speech enabled device may include a wakeword (WW) engine that processes input audio data to detect a representation of a wakeword. When a wakeword is detected in the input audio data, the speech enabled device may generate input audio data corresponding to the wakeword and send the input audio data to a remote system for speech processing. Thus, the system 100 may evaluate the beamformed audio data 962 to determine performance parameters associated with the wakeword engine, such as a false rejection rate (FRR) or the like.

Similarly, the system 100 may evaluate the beamformed audio data 962 to determine performance parameters associated with ASR. Automatic speech recognition (ASR) is a field of computer science, artificial intelligence, and linguistics concerned with transforming audio data associated with speech into text data representative of that speech. Thus, the system 100 may perform ASR processing on the beamformed audio data 962 to generate ASR data 972 and may compare the ASR data 972 to the text data 134 to determine performance parameters associated with ASR, such as a word error rate (WER) and/or the like.

Figure 9B:
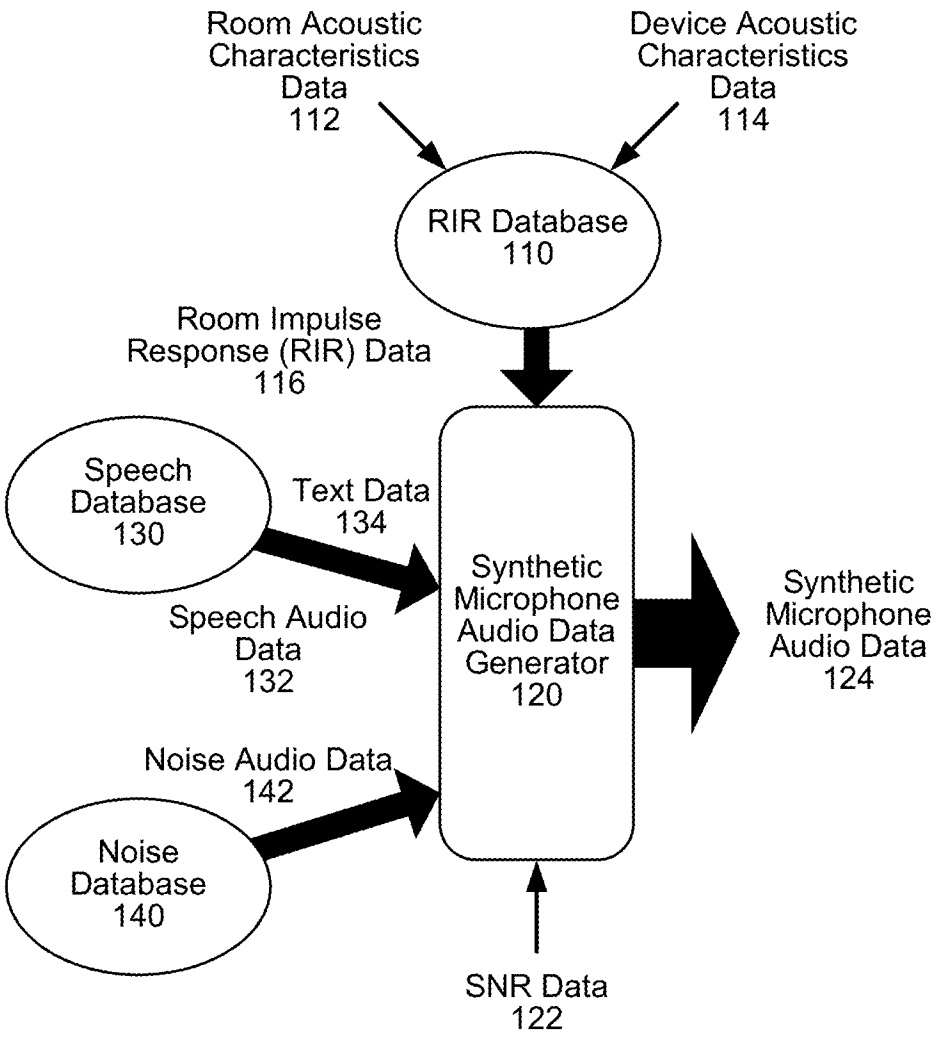

While FIG. 9A illustrates a detailed example of processing the synthetic microphone audio data 124 and generating a final report 152 using the statistics generator 150, the disclosure is not limited thereto. Instead, FIG. 9B illustrates that the system 100 may generate the synthetic microphone audio data 124 for any sort of data analysis, not just simulating the microphone array. For example, the system 100 may use the synthetic microphone audio data 124 for training or other purposes, without departing from the disclosure.

Figure 10A:
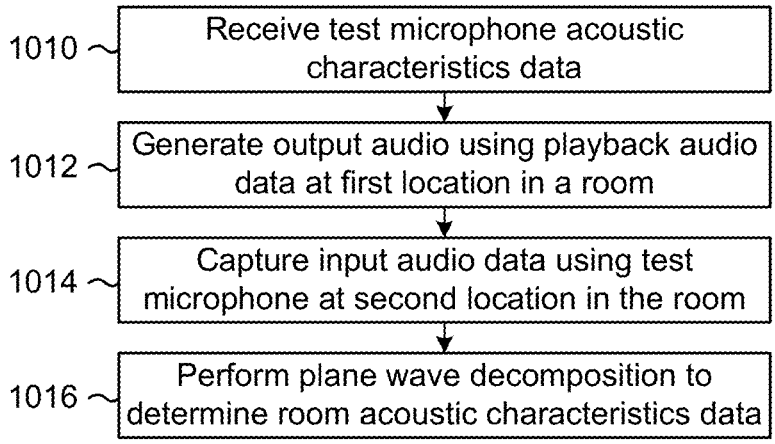
FIGS. 10A-10E are flowcharts conceptually illustrating example methods for generating estimated room impulse response data according to embodiments of the present disclosure.

FIGS. 10A-10E are flowcharts conceptually illustrating example methods for generating estimated room impulse response data according to embodiments of the present disclosure. In some examples, the system 100 may generate room acoustic characteristics data as described in greater detail above with regard to FIG. 5. As illustrated in FIG. 10A, the system 100 may receive (1010) test microphone acoustic characteristics data associated with a test microphone array, may generate (1012) output audio using playback audio data at a first location in a room, may capture (1014) input audio data using the test microphone array (e.g., an EigenMike, although the disclosure is not limited thereto) at a second location in the room, and may perform (1016) plane wave decomposition to determine room acoustic characteristics data associated with the room.

As discussed above with regard to FIG. 5, the test microphone acoustic characteristics data corresponds to device acoustic characteristics data that is specific to the test microphone array. Thus, the test microphone acoustic characteristics data is known and used to compensate for any scattering caused by the test microphone array, isolating the incident acoustic waves at the second location. To estimate the room impulse response, the system 100 may replace the test microphone acoustic characteristics data with the device acoustic characteristics data specific to a desired microphone array upon which to perform the simulations (e.g., simulated microphone array).

For ease of illustration, the disclosure will refer to a microphone array included in a simulation as a "simulated microphone array," regardless of whether the microphone array is a physical microphone array or a "digital" microphone array. Thus, the simulated microphone array may correspond to a physical microphone array included in a physical device (e.g., actual prototype or other device for which the system 100 will perform testing via simulation) or may correspond to a digital microphone array that has been designed or included in a digital model for a device but not yet created in physical form. The system 100 may determine the device acoustic characteristics data for the microphone array either by physical measurement of the microphone array or by simulation using the digital model without departing from the disclosure.

Figure 10B:
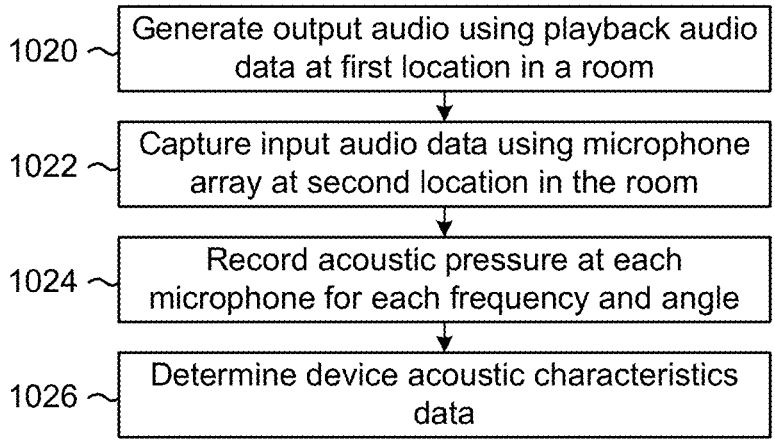

In some examples, the system 100 may generate device acoustic characteristics data using physical measurements of a microphone array included in a physical device. As illustrated in FIG. 10B, the system 100 may generate (1020) output audio using playback audio data at a first location in a room, may capture (1022) input audio data using a microphone array at a second location in the room, may record (1024) acoustic pressure at each microphone for each frequency and angle, and may determine (1026) device acoustic characteristics data.

Figure 10C:
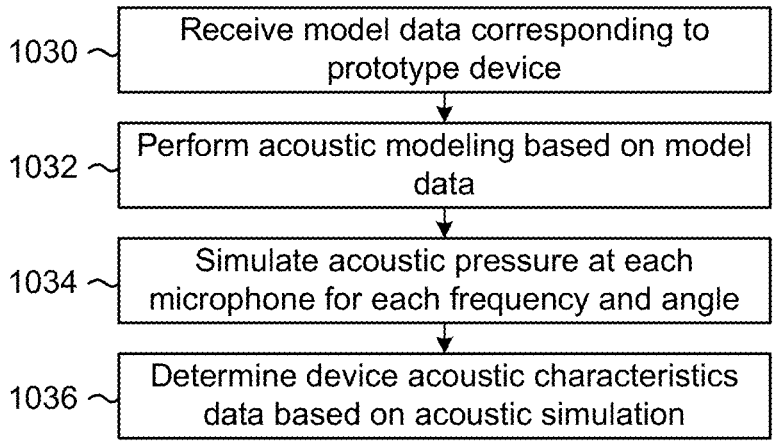

In other examples, the system 100 may generate device acoustic characteristics data for a microphone array using a simulation of the microphone array (e.g., using a model of a prototype device that includes the simulated microphone array), such as by using the simulation tools described in FIGS. 6A-8. As illustrated in FIG. 10C, the system 100 may receive (1030) model data corresponding to the prototype device, may perform (1032) acoustic modeling based on the model data, simulate (1034) acoustic pressure at each microphone for each frequency and angle, and determine (1036) device acoustic characteristics data based on the acoustic simulation.

Figure 10D:
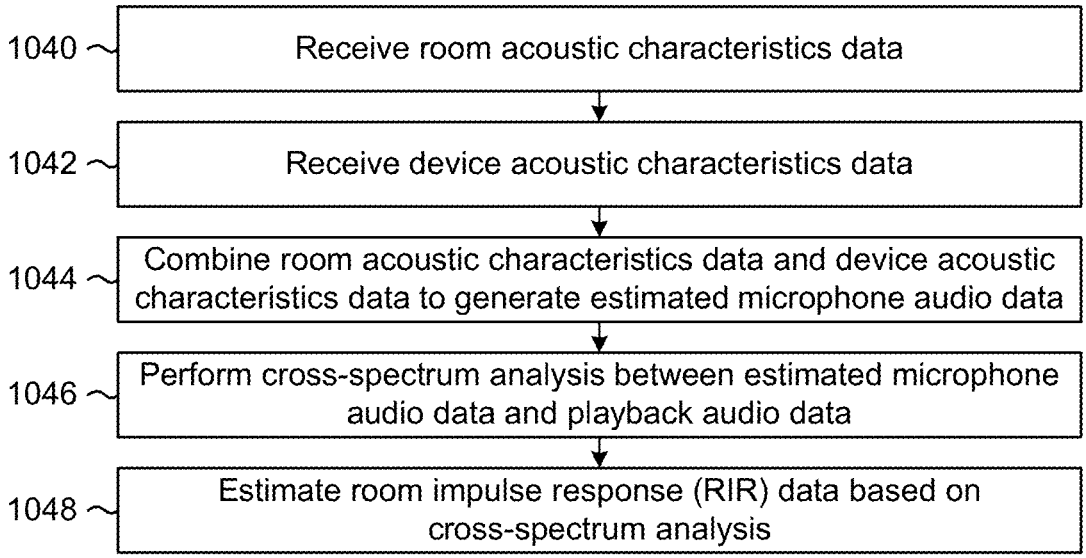

FIG. 10D illustrates an example of combining the room acoustic characteristics data and the device acoustic characteristics data to estimate a room impulse response (RIR) for a room using the simulated microphone array. As illustrated in FIG. 10D, the system 100 may receive (1040) room acoustic characteristics data and may receive (1042) device acoustic characteristics data. The system 100 may then combine (1044) the room acoustic characteristics data and the device acoustic characteristics data to generate estimated microphone audio data, may perform (1046) cross-spectrum analysis between the estimated microphone audio data and playback audio data used to generate the room acoustic characteristics data, and may estimate (1048) the room impulse response (RIR) data based on the cross-spectrum analysis. While FIG. 10D illustrates the system 100 performing a cross-spectrum analysis, the disclosure is not limited thereto and the system 100 may estimate the room impulse response data using any techniques known to one of skill in the art. For example, the system 100 may perform cross-spectrum analysis in the frequency domain, cross-correlation analysis in the time domain, determine an inter-channel response, and/or the like without departing from the disclosure. Thus, step 1046 corresponds to determining a multi-channel system identification, system learning, or the like and is included to provide a non-limiting example of how the system 100 determines the RIR data.

Figure 10E:
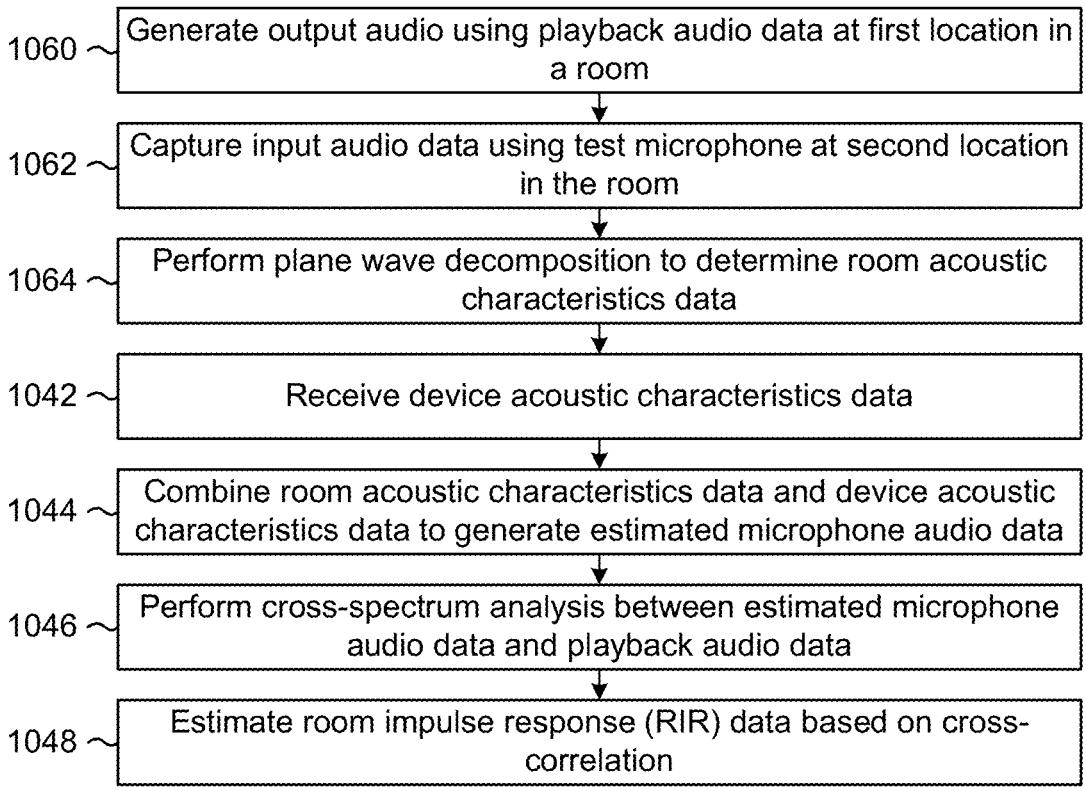

FIG. 10E illustrates an example of estimating the room impulse response (RIR) for a room in a single process. As illustrated in FIG. 10E, the system 100 may generate (1060) output audio using playback audio data at a first location in a room, may capture (1062) input audio data using a test microphone array (e.g., an EigenMike, although the disclosure is not limited thereto) at a second location in the room, and may perform (1064) plane wave decomposition to determine room acoustic characteristics data associated with the room. The system 100 may receive (1042) device acoustic characteristics data, combine (1044) the room acoustic characteristics data and the device acoustic characteristics data to generate estimated microphone audio data, may perform (1046) cross-spectrum analysis between the estimated microphone audio data and playback audio data used to generate the room acoustic characteristics data, and may estimate (1048) the room impulse response (RIR) data based on the cross-spectrum analysis.

Figure 11:
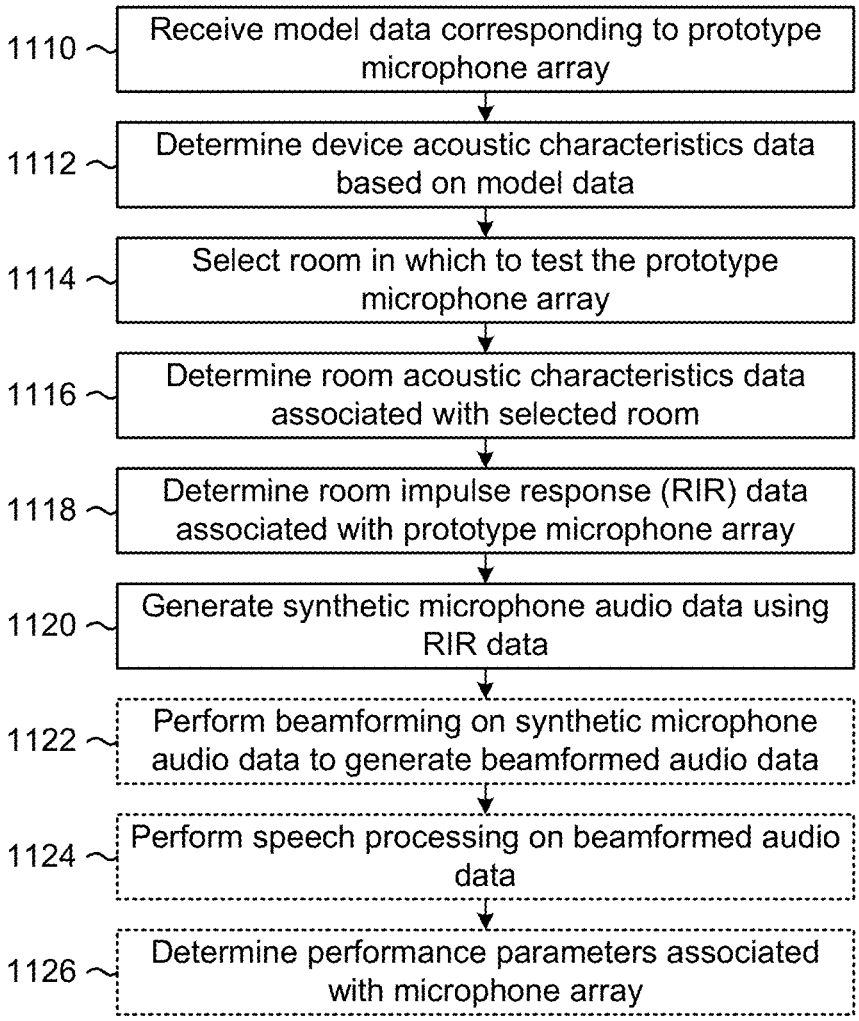
FIG. 11 is a flowchart conceptually illustrating an example method for performing a simulation and determining performance parameters according to embodiments of the present disclosure.

FIG. 11 is a flowchart conceptually illustrating an example method for performing a simulation and determining performance parameters according to embodiments of the present disclosure. As illustrated in FIG. 11, the system 100 may receive (1110) model data corresponding to a prototype microphone array (e.g., microphone array to simulate) and may determine (1112) device acoustic characteristics data based on the model data. The system 100 may select (1114) a room in which to test the prototype microphone array and determine (1116) room acoustic characteristics data associated with the selected room. The system 100 may determine (1118) room impulse response (RIR) data associated with the prototype microphone array and may generate (1120) synthetic microphone audio data using the RIR data.

In some examples, the system 100 may perform (1122) beamforming on the synthetic microphone audio data to generate beamformed audio data, perform (1124) speech processing on the beamformed audio data, and determine (1126) performance parameters associated with the microphone array, as described in greater detail above with regard to FIG. 9A. However, as this is optional, steps 1122-1126 are illustrated in FIG. 11 using dashed lines to indicate that these steps are not required. Instead, the synthetic microphone audio data may be used for any data analysis and/or training without determining performance parameters of the microphone array.

Figure 12A:
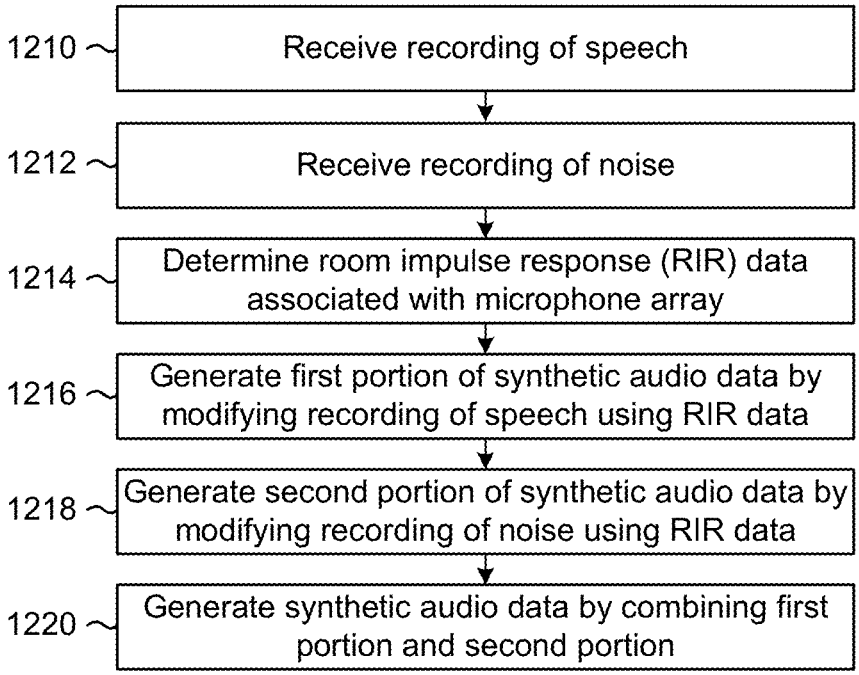
FIGS. 12A-12B are flowcharts conceptually illustrating example methods for generating synthetic microphone audio data and determining performance parameters according to embodiments of the present disclosure.
Figure 12B:
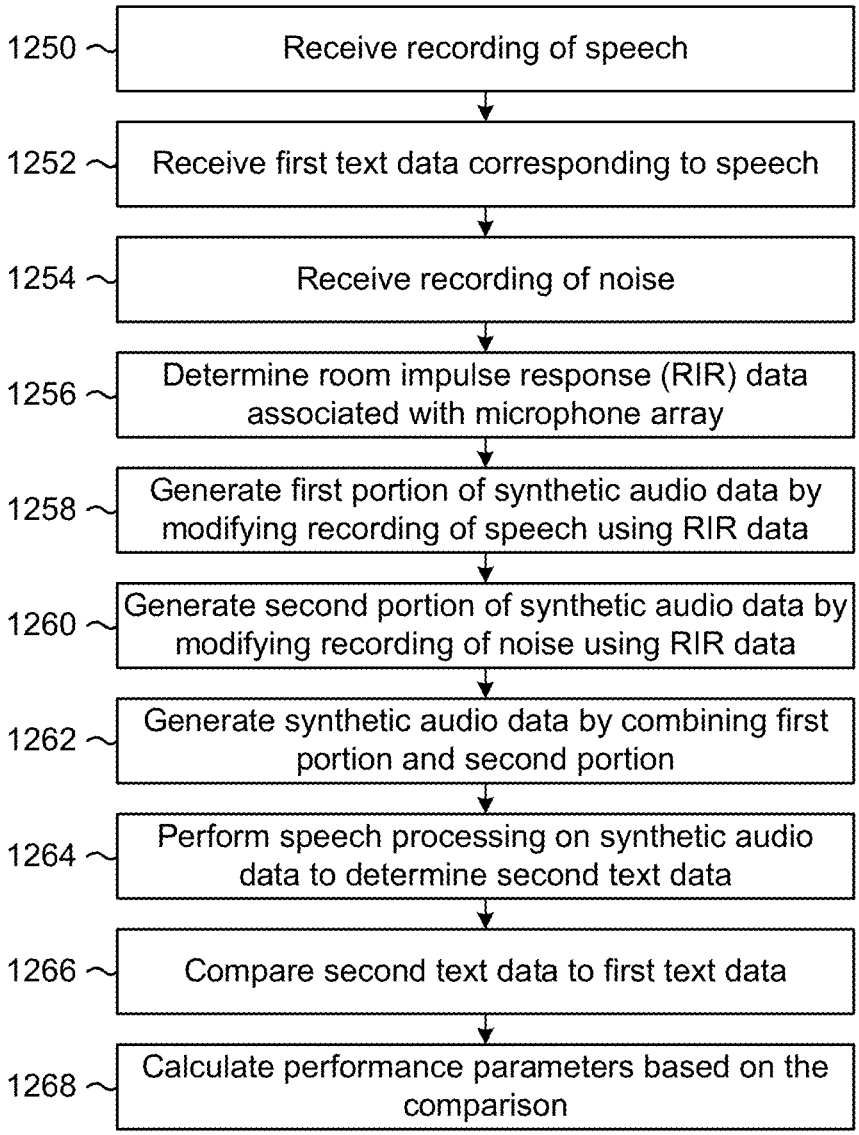

FIGS. 12A-12B are flowcharts conceptually illustrating example methods for generating synthetic microphone audio data and determining performance parameters according to embodiments of the present disclosure. As illustrated in FIG. 12A, the system 100 may receive (1210) a recording of speech and receive (1212) a recording of noise. The system 100 may determine (1214) room impulse response (RIR) data associated with a microphone array and generate (1216) a first portion of synthetic audio data by modifying the recording of speech using the RIR data. For example, the system 100 may convolve the recording of speech and the RIR data to simulate the microphone array capturing the recording of speech. In addition, the system 100 may generate (1218) a second portion of the synthetic audio data by modifying the recording of noise using the RIR data. For example, the system 100 may convolve the recording of noise and the RIR data to simulate the microphone array capturing the recording of noise. The system 100 may then generate (1220) the synthetic audio data by combining the first portion and the second portion. For example, the system 100 may combine the first portion and the second portion based on a desired signal-to-noise ratio (SNR) value or the like. While not illustrated in FIG. 12A, the system 100 may perform other analysis using the synthetic audio data, as described in greater detail above.

As illustrated in FIG. 12B, the system 100 may receive (1250) a recording of speech, receive (1252) first text data corresponding to the speech, and receive (1254) a recording of noise. The system 100 may determine (1256) room impulse response (RIR) data associated with a microphone array and generate (1258) a first portion of synthetic audio data by modifying the recording of speech using the RIR data. For example, the system 100 may convolve the recording of speech and the RIR data to simulate the microphone array capturing the recording of speech. In addition, the system 100 may generate (1260) a second portion of the synthetic audio data by modifying the recording of noise using the RIR data. For example, the system 100 may convolve the recording of noise and the RIR data to simulate the microphone array capturing the recording of noise. The system 100 may then generate (1262) the synthetic audio data by combining the first portion and the second portion. For example, the system 100 may combine the first portion and the second portion based on a desired signal-to-noise ratio (SNR) value or the like.

The system 100 may then perform (1264) speech processing on the synthetic audio data to determine second text data, may compare (1266) the second text data to the first text data, and may calculate (1268) performance parameters based on the comparison. While not illustrated in FIG. 12B, the system 100 may perform other analysis using the synthetic audio data, as described in greater detail above.

Figure 13:
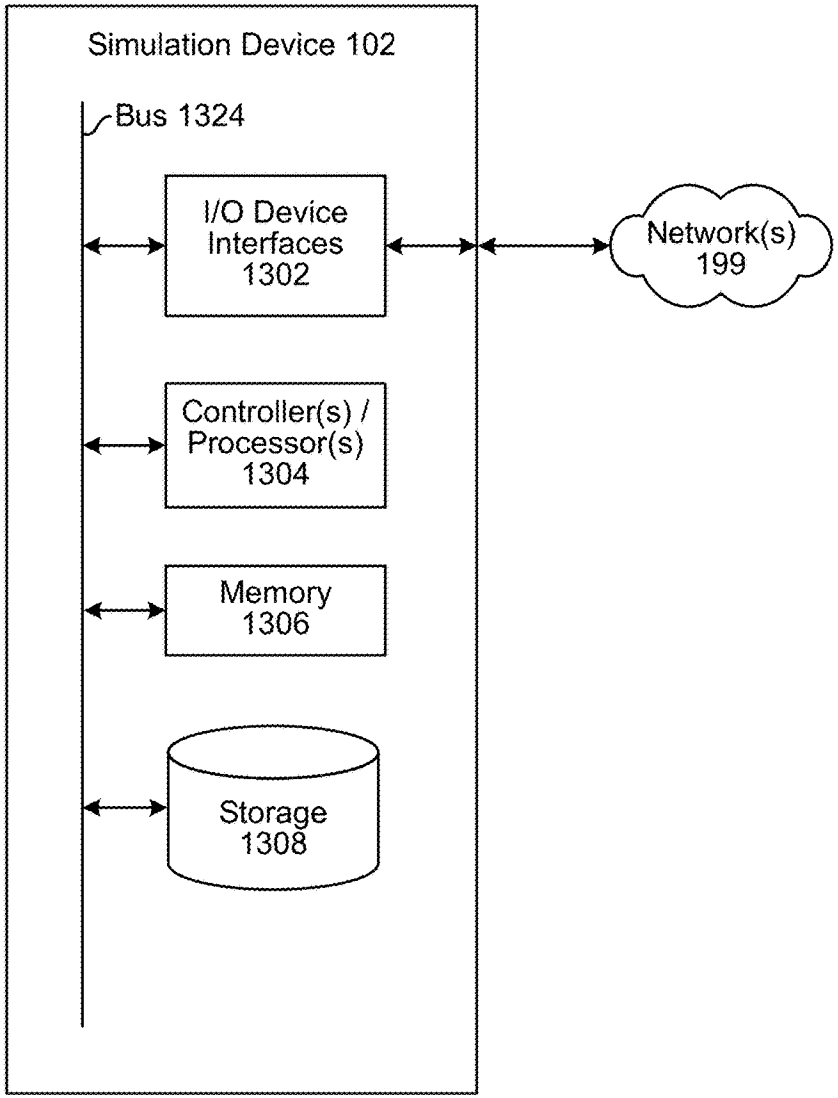
FIG. 13 is a block diagram conceptually illustrating example components of a simulation device according to embodiments of the present disclosure.

FIG. 13 is a block diagram conceptually illustrating example components of the simulation device 102. In operation, the device 102 may include computer-readable and computer-executable instructions that reside on the device, as will be discussed further below.

The device 102 may include an address/data bus 1324 for conveying data among components of the device 102. Each component within the device may also be directly connected to other components in addition to (or instead of) being connected to other components across the bus 1324.

The device 102 may include one or more controllers/processors 1304, which may each include a central processing unit (CPU) for processing data and computer-readable instructions, and a memory 1306 for storing data and instructions. The memory 1306 may include volatile random access memory (RAM), non-volatile read only memory (ROM), non-volatile magnetoresistive (MRAM) and/or other types of memory. The device 102 may also include a data storage component 1308, for storing data and controller/processor-executable instructions (e.g., instructions to perform operations discussed herein). The data storage component 1308 may include one or more non-volatile storage types such as magnetic storage, optical storage, solid-state storage, etc. The device 102 may also be connected to removable or external non-volatile memory and/or storage (such as a removable memory card, memory key drive, networked storage, etc.) through the input/output device interfaces 1302.

Computer instructions for operating the device 102 and its various components may be executed by the controller(s)/processor(s) 1304, using the memory 1306 as temporary "working" storage at runtime. The computer instructions may be stored in a non-transitory manner in non-volatile memory 1306, storage 1308, or an external device. Alternatively, some or all of the executable instructions may be embedded in hardware or firmware in addition to or instead of software.

The device 102 may include input/output device interfaces 1302. A variety of components may be connected through the input/output device interfaces 1302, such as a microphone array (not illustrated), loudspeaker(s) (not illustrated), and/or the like. The input/output device interfaces 1302 may also include an interface for an external peripheral device connection such as universal serial bus (USB), FireWire, Thunderbolt or other connection protocol. The input/output device interfaces 1302 may also include a connection to one or more networks 199 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, 4G network, 5G network, etc. A wired connection such as Ethernet may also be supported. Through the network(s) 199, the system 100 may be distributed across a networked environment. The I/O device interfaces 1302 may also include communication components that allow data to be exchanged between devices such as different physical servers in a collection of servers or other components.

The components of the device(s) 102 may include their own dedicated processors, memory, and/or storage. Alternatively, one or more of the components of the device(s) 102 may utilize the I/O interfaces 1302, processor(s) 1304, memory 1306, and/or storage 1308 of the device(s) 108.

As noted above, multiple devices may be employed in a single system. In such a multi-device system, each of the devices may include different components for performing different aspects of the system's processing. The multiple devices may include overlapping components. The components listed in any of the figures herein are exemplary, and may be included a stand-alone device or may be included, in whole or in part, as a component of a larger device or system.

The concepts disclosed herein may be applied within a number of different devices and computer systems, including, for example, general-purpose computing systems (e.g., desktop computers, laptop computers, tablet computers, etc.), server-client computing systems, distributed computing environments, speech processing systems, mobile devices (e.g., cellular phones, personal digital assistants (PDAs), tablet computers, etc.), and/or the like.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers and speech processing should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk, and/or other media. In addition, components of the system 100 may be implemented as in firmware or hardware, such as an acoustic front end (AFE), which comprises, among other things, analog and/or digital filters (e.g., filters configured as firmware to a digital signal processor (DSP)).

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without other input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

receiving first device acoustic characteristics data representing a frequency response of a first microphone array, the first microphone array being spherical and including a plurality of microphones;

generating, by a loudspeaker at a first location in a room, output audio using playback audio data;

generating, using the first microphone array at a second location in the room, input audio data by capturing a portion of the output audio, the input audio data including a first representation of the portion of the output audio;

determining, using the input audio data and the first device acoustic characteristics data, room acoustic characteristics data representing a plurality of acoustic waves at the second location;

determining second device acoustic characteristics data representing an estimated frequency response of a second microphone array, the second microphone array included in a digital model for a device;

generating, using the room acoustic characteristics data and the second device acoustic characteristics data, estimated microphone audio data including a second representation of the portion of the output audio as though the second microphone array captured the portion of the output audio at the second location;

determining cross-spectrum data representing a cross-spectrum analysis between the playback audio data and the estimated microphone audio data; and determining, using the cross-spectrum data, estimated room impulse response data representing a system response between the loudspeaker at the first location and the second microphone array at the second location, the system response indicating combined acoustics for the room and the device.

2. The computer-implemented method of claim 1, further comprising:

receiving first audio data including a first representation of speech;

receiving first text data representing text corresponding to the first representation of speech;

generating, using the first audio data and the estimated room impulse response data, a first portion of output audio data, the output audio data including a second representation of the speech as though captured by the second microphone array;

receiving second audio data representing acoustic noise;

generating, using the second audio data and the estimated room impulse response data, a second portion of the output audio data;

generating the output audio data by combining the first portion and the second portion;

performing speech processing on the output audio data to determine second text data; and comparing the second text data to the first text data to determine a word error rate, the word error rate calculated using the first text data as a reference and indicating a percentage of the second text data that matches the first text data.

3. The computer-implemented method of claim 1, wherein determining the room acoustic characteristics data further comprises:

determining the room acoustic characteristics data by performing plane wave decomposition on the input audio data using the first device acoustic characteristics data, the room acoustic characteristics data representing a sum of the plurality of acoustic waves at the second location, the plurality of acoustic waves generated by the loudspeaker based on the playback audio data.

4. The computer-implemented method of claim 1, further comprising:

generating the digital model for the device; and performing acoustic modeling to determine the second device acoustic characteristics data associated with the second microphone array, the second device acoustic characteristics data representing at least a first vector and a second vector, the acoustic modeling further comprising:

generating a first value of the first vector by calculating a first acoustic pressure at a first microphone of the second microphone array in response to a first acoustic wave of a plurality of acoustic waves, the first acoustic wave being an acoustic plane wave;

generating a second value of the first vector by calculating a second acoustic pressure at a second microphone of the second microphone array in response to the first acoustic wave;

generating a third value of the second vector by calculating a third acoustic pressure at the first microphone of the second microphone array in response to a second acoustic wave of the plurality of acoustic waves, the second acoustic wave being a spherical acoustic wave;

generating a fourth value of the second vector by calculating a fourth acoustic pressure at the second microphone of the second microphone array in response to the second acoustic wave.

5. A computer-implemented method comprising:

sending first audio data to a loudspeaker that is at a first location in a room;

generating second audio data using a first microphone array at a second location in the room;

determining first acoustic characteristics data corresponding to the second location, wherein the determining is based on the second audio data and second acoustic characteristics data representing a first frequency response associated with the first microphone array;

receiving third acoustic characteristics data representing a second frequency response associated with a second microphone array, the second microphone array not present in the room; and generating estimated impulse response data corresponding to a simulation of the second microphone array positioned at the second location, wherein the estimated impulse response data is generated based on the first audio data, the first acoustic characteristics data, and the third acoustic characteristics data.

6. The computer-implemented method of claim 5, wherein generating the estimated impulse response data further comprises:

generating, using the first acoustic characteristics data and the third acoustic characteristics data, third audio data corresponding to a simulation of audio being captured by the second microphone array at the second location;

determining cross-spectrum analysis data corresponding to a cross-spectrum analysis between the first audio data and the third audio data; and determining, using the cross-spectrum analysis data, the estimated impulse response data.

7. The computer-implemented method of claim 5, further comprising:

receiving third audio data including a first representation of speech;

receiving first text data representing text corresponding to the first representation of the speech;

generating, using the third audio data and the estimated impulse response data, a first portion of output audio data, the output audio data including a second representation of the speech as though captured by the second microphone array;

receiving fourth audio data representing acoustic noise;

generating, using the fourth audio data and the estimated impulse response data, a second portion of the output audio data;

generating the output audio data by combining the first portion and the second portion;

performing speech processing on the output audio data to determine second text data; and determining, using the first text data and the second text data, a performance parameter associated with the second microphone array.

8. The computer-implemented method of claim 5, wherein the first acoustic characteristics data corresponds to a sum of a plurality of acoustic waves at the second location, the plurality of acoustic waves generated by the loudspeaker based on the first audio data.

9. The computer-implemented method of claim 5, wherein determining the first acoustic characteristics data further comprises:

receiving the second acoustic characteristics data corresponding to the first microphone array; and determining the first acoustic characteristics data by performing plane wave decomposition on the second audio data using the second acoustic characteristics data.

10. The computer-implemented method of claim 5, wherein the third acoustic characteristics data represents at least a first anechoic response of the second microphone array to an acoustic plane wave and a second anechoic response of the second microphone array to a spherical acoustic wave.

11. The computer-implemented method of claim 5, wherein the third acoustic characteristics data includes at least one vector representing a plurality of values, a first number of the plurality of values corresponding to a second number of microphones in the second microphone array, a first value of the plurality of values corresponding to a first microphone of the second microphone array and representing an acoustic pressure at the first microphone in response to an acoustic wave.

12. The computer-implemented method of claim 5, further comprising:

generating a digital model for a device that includes the second microphone array; and performing acoustic modeling to determine the third acoustic characteristics data associated with the second microphone array, the third acoustic characteristics data representing a plurality of vectors, a first vector of the plurality of vectors corresponding to a first acoustic wave of a plurality of acoustic waves.

13. A system comprising:

at least one processor; and memory including instructions operable to be executed by the at least one processor to cause the system to:

send first audio data to a loudspeaker that is at a first location in a room;

generate second audio data using a first microphone array at a second location in the room;

determine first acoustic characteristics data corresponding to the second location, wherein the determining is based on the second audio data and second acoustic characteristics data representing a first frequency response associated with the first microphone array;

receive third acoustic characteristics data representing a second frequency response associated with a second microphone array, the second microphone array not present in the room; and generate estimated impulse response data corresponding to a simulation of the second microphone array positioned at the second location, wherein the estimated impulse response data is generated based on the first audio data, the first acoustic characteristics data, and the third acoustic characteristics data.

14. The system of claim 13, wherein the memory further comprises instructions that, when executed by the at least one processor, further cause the system to:

generate, using the first acoustic characteristics data and the third acoustic characteristics data, third audio data corresponding to a simulation of audio being captured by the second microphone array at the second location;

determine cross-spectrum analysis data corresponding to a cross-spectrum analysis between the first audio data and the third audio data; and determine, using the cross-spectrum analysis data, the estimated impulse response data.

15. The system of claim 13, wherein the memory further comprises instructions that, when executed by the at least one processor, further cause the system to:

receive third audio data including a first representation of speech;

receive first text data representing text corresponding to the first representation of the speech;

generate, using the third audio data and the estimated impulse response data, a first portion of output audio data, the output audio data including a second representation of the speech as though captured by the second microphone array;

receive fourth audio data representing acoustic noise;

generate, using the fourth audio data and the estimated impulse response data, a second portion of the output audio data;

generate the output audio data by combining the first portion and the second portion;

perform speech processing on the output audio data to determine second text data; and determine, using the first text data and the second text data, a performance parameter associated with the second microphone array.

16. The system of claim 13, wherein the first acoustic characteristics data corresponds to a sum of a plurality of acoustic waves at the second location, the plurality of acoustic waves generated by the loudspeaker based on the first audio data.

17. The system of claim 13, wherein the memory further comprises instructions that, when executed by the at least one processor, further cause the system to:

receive the second acoustic characteristics data corresponding to the first microphone array; and determine the first acoustic characteristics data by performing plane wave decomposition on the second audio data using the second acoustic characteristics data.

18. The system of claim 13, wherein the third acoustic characteristics data represents at least a first anechoic response of the second microphone array to an acoustic plane wave and a second anechoic response of the second microphone array to a spherical acoustic wave.

19. The system of claim 13, wherein the third acoustic characteristics data includes at least one vector representing a plurality of values, a first number of the plurality of values corresponding to a second number of microphones in the second microphone array, a first value of the plurality of values corresponding to a first microphone of the second microphone array and representing an acoustic pressure at the first microphone in response to an acoustic wave.

20. The system of claim 13, wherein the memory further comprises instructions that, when executed by the at least one processor, further cause the system to:

generate a digital model for a device that includes the second microphone array; and perform acoustic modeling to determine the third acoustic characteristics data associated with the second microphone array, the third acoustic characteristics data representing a plurality of vectors, a first vector of the plurality of vectors corresponding to a first acoustic wave of a plurality of acoustic waves.

* * * * *